US010857583B2

(12) United States Patent
Yoshikawa et al.

(10) Patent No.: US 10,857,583 B2
(45) Date of Patent: Dec. 8, 2020

(54) PRESS-WORKING APPARATUS, PRESS-WORKING METHOD, AND PRESS-MOLDED PRODUCT

(71) Applicant: NIPPON STEEL & SUMITOMO METAL CORPORATION, Tokyo (JP)

(72) Inventors: Nobuo Yoshikawa, Tokyo (JP); Yasuhiro Ito, Tokyo (JP); Shigeru Yonemura, Tokyo (JP); Tohru Yoshida, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 420 days.

(21) Appl. No.: 15/564,697

(22) PCT Filed: Apr. 28, 2016

(86) PCT No.: PCT/JP2016/063341
§ 371 (c)(1),
(2) Date: Oct. 5, 2017

(87) PCT Pub. No.: WO2016/175281
PCT Pub. Date: Nov. 3, 2016

(65) Prior Publication Data

US 2018/0104735 A1 Apr. 19, 2018

(30) Foreign Application Priority Data

Apr. 28, 2015 (JP) ..... 2015-091190
Apr. 26, 2016 (JP) ..... 2016-088085

(51) Int. Cl.
*B21D 22/06* (2006.01)
*B21D 24/00* (2006.01)
(Continued)

(52) U.S. Cl.
CPC ..... *B21D 24/005* (2013.01); *B21D 22/06* (2013.01); *B21D 22/26* (2013.01); *B21D 22/30* (2013.01);
(Continued)

(58) Field of Classification Search
CPC ..... B21J 5/08; B21J 5/025; B21J 9/06; B21D 22/21; B21D 22/06; B21D 22/28;
(Continued)

(56) References Cited

U.S. PATENT DOCUMENTS 5,924,188 A * 7/1999 Tokunou ..... B21D 51/10 29/603.12
9,421,597 B2 * 8/2016 Yamamoto ..... B21K 21/16
(Continued)

FOREIGN PATENT DOCUMENTS

CN 101585100 A 11/2009
CN 104105557 A 10/2014
(Continued)

OTHER PUBLICATIONS

Kuno Hironori, Translation of JP2004098153 (Year: 2006).*
(Continued)

*Primary Examiner* — Adam J Eiseman
*Assistant Examiner* — Bobby Yeonjin Kim
(74) *Attorney, Agent, or Firm* — Birch, Stewart, Kolasch & Birch, LLP

(57) ABSTRACT

[Object] To enable flexible molding of a punch-nose in press working for obtaining a molded product including a U-shaped portion in a cross-section.
[Solution] Provided is a press-working apparatus configured to provide a molded product by performing press working on a work, the molded product including, in a cross-section, a U-shaped portion including a bottom, a wall, and a punch-nose between the bottom and the wall, the press-
(Continued)

working apparatus including: a die in which a recessed portion to receive the U-shaped portion is formed; a first punch that sandwiches a central area of the bottom with a bottom surface of the recessed portion; and a second punch that is pushed into the recessed portion later than the first punch, to restrain the wall between the second punch and a side surface of the recessed portion, and sandwich the work with the bottom surface to mold a peripheral area of the bottom and the punch-nose. A sandwiching width of the first punch that sandwiches the central area of the bottom and a setback amount of the second punch from the first punch in a push-in direction are set on the basis of a target sheet thickness of the punch-nose.

17 Claims, 27 Drawing Sheets

(51) Int. Cl.

| | |
|---|---|
| ***B21D 22/30*** | (2006.01) |
| ***B21J 5/08*** | (2006.01) |
| ***B21D 22/26*** | (2006.01) |
| *B21D 22/02* | (2006.01) |
| *B21J 5/02* | (2006.01) |

(52) U.S. Cl.
CPC ..... *B21J 5/08* (2013.01); *B21D 22/022* (2013.01); *B21J 5/025* (2013.01)

(58) Field of Classification Search
CPC ..... B21D 22/26; B21D 22/30; B21D 22/20; B21D 24/005
See application file for complete search history.

(56) References Cited

U.S. PATENT DOCUMENTS

| | | | | |
|---|---|---|---|---|
| 10,022,763 | B2 * | 7/2018 | Tanaka | B21D 5/01 |
| 2008/0309834 | A1 | 12/2008 | Yi et al. | |
| 2009/0007999 | A1 * | 1/2009 | Asai | B21D 22/26 148/654 |
| 2015/0093591 | A1 * | 4/2015 | Walde | B21D 22/21 428/603 |
| 2015/0114067 | A1 | 4/2015 | Shimizu | |
| 2015/0239029 | A1 | 8/2015 | Yamamoto et al. | |
| 2016/0200363 | A1 * | 7/2016 | Ito | B21D 22/20 428/595 |

FOREIGN PATENT DOCUMENTS

| | | | | |
|---|---|---|---|---|
| JP | 9-174166 | A | 7/1997 | |
| JP | 9-295088 | A | 11/1997 | |
| JP | H06218442 | * | 11/1997 | B21D 22/30 |
| JP | 2001-198641 | A | 7/2001 | |
| JP | 2004-98153 | A | 4/2004 | |
| JP | 2004098153 | * | 10/2006 | B21D 22/28 |
| JP | 2007-111725 | A | 5/2007 | |
| JP | 2009-90318 | A | 4/2009 | |
| JP | 2009-208149 | A | 9/2009 | |
| JP | 2009-248092 | A | 10/2009 | |
| JP | 2010-137261 | A | 6/2010 | |
| JP | 2009208149 | * | 11/2013 | B21D 22/02 |
| WO | WO 2014/065290 | A1 | 5/2014 | |
| WO | WO 2014/185357 | A1 | 11/2014 | |
| WO | WO-2015097541 | A1 * | 7/2015 | B21D 22/06 |

OTHER PUBLICATIONS

Sasaki Jiro, Translation of JPH06218442 (Year: 1997).*
Kanamori Kenji, Translation of JP2009208149 (Year: 2013).*
International Search Report for PCT/JP2016/063341 dated Jul. 26, 2016.
Written Opinion of the International Searching Authority for PCT/JP2016/063341 (PCT/ISA/237) dated Jul. 26, 2016.
Korean Office Action, dated Nov. 13, 2018, for corresponding Korean Application No. 10-2017-7030776, with a partial English translation.
Chinese Office Action dated, Jul. 2, 2019, for corresponding Chinese Application No. 201680023290.9, with an English translation.
Indonesian Office Action, dated May 13, 2019, for Indonesian Application No. P00201707413, with an English translation.
Korean Office Action, dated Jun. 24, 2019, for corresponding Korean Application No. 10-2017-7030776, with an English translation.
Japanese Office Action, dated Feb. 26, 2019, for corresponding Japanese Application No. 2017-515606, with a partial English translation.
Chinese Office Action and Search Report, dated Oct. 15, 2018, for corresponding Chinese Appfication No. 201680023290.9, with a partial English transtation.
Japanese Office Action, dated Nov. 6, 2018, for corresponding Japanese Application No. 2017-515606, with a partial English translation.
Indian Examination Report for corresponding Indian Application No. 201717034723, dated Sep. 11, 2019, with English translation.
Japanese Notice of Reasons for Refusal dated Apr. 7, 2020, for corresponding Japanese Application No. 2019-074907, with English translation.

* cited by examiner

PRESS-WORKING APPARATUS, PRESS-WORKING METHOD, AND PRESS-MOLDED PRODUCT

TECHNICAL FIELD

The present invention relates to a press-working apparatus, a press-working method, and a press-molded product, and particularly relates to a press-working apparatus and a press-working method for obtaining a molded product including a U-shaped portion in a cross-section, and a press-molded product obtained by such an apparatus or method.

BACKGROUND ART

Long channel materials and hat-shaped materials molded by press working are generally used as, for example, structural parts of vehicles and the like. High strength is required of structural parts of vehicles in order to ensure crash safety, vehicle body rigidity, etc. In addition, axisymmetric cup-shaped materials similarly molded by press working are generally used as, for example, rotation members such as drums and hubs in transmissions of vehicles. High strength is required of rotation members as well in order to withstand transmitted torque.

The channel materials and hat-shaped materials and the cup-shaped materials described above all include a U-shaped portion in a cross-section. The U-shaped portion includes a wall, a bottom, and a punch-nose between the wall and the bottom. In the case where strength is required of a member as described above, the sheet thickness of the member needs to be ensured sufficiently in this U-shaped portion. Hence, as described in Patent Literature 1, for example, a technology of making the distance between a die and a punch larger than the sheet thickness of a work in press working, and pushing in an end of a wall after formation of the outline of a U-shaped portion, thereby increasing the sheet thickness of (thickening) the entire U-shaped portion including a punch-nose has been known.

CITATION LIST

Patent Literature

Patent Literature 1: JP 2009-208149A

SUMMARY OF INVENTION

Technical Problem

In the conventional technology described above, when the end of the wall is pushed in, a material is caused to flow between the wall and the bottom to thicken the entire U-shaped portion. Therefore, it is necessary to make the outside of the punch-nose have a shape with curvature and make the curvature radius large to some extent, which limits design. In addition, since the U-shaped portion is entirely thickened, it is difficult to perform working to thicken only the punch-nose to a desired sheet thickness, for example.

Hence, the present invention has been made in view of the above problems, and an object of the present invention is to provide a novel and improved press-working apparatus, press-working method, and press-molded product that enable flexible molding of a punch-nose in press working for obtaining a molded product including a U-shaped portion in a cross-section.

Solution to Problem

According to an aspect of the present invention in order to achieve the above-mentioned object, there is provided a press-working apparatus configured to provide a molded product by performing press working on a work, the molded product including, in a cross-section, a U-shaped portion including a bottom, a wall, and a punch-nose between the bottom and the wall, the press-working apparatus including: a die in which a recessed portion to receive the U-shaped portion is formed; a first punch that sandwiches a central area of the bottom with a bottom surface of the recessed portion; and a second punch that is pushed into the recessed portion later than the first punch, to restrain the wall between the second punch and a side surface of the recessed portion, and sandwich the work with the bottom surface to mold a peripheral area of the bottom and the punch-nose. A sandwiching width of the first punch that sandwiches the central area of the bottom and a setback amount of the second punch from the first punch in a push-in direction are set on the basis of a target sheet thickness of the punch-nose.

In the press-working apparatus, the work may have a flat plate shape at the time of starting the press working, and the first punch and the second punch may push the flat-plate-shaped work into the recessed portion while maintaining a state where the second punch is set back relative to the first punch by first pressing, to mold the wall and the central area of the bottom.

The second punch may be pushed into the recessed portion by second press working, to sandwich the work with the bottom surface to mold the peripheral area of the bottom and the punch-nose.

The sandwiching width of the first punch and the setback amount of the second punch may be set in a manner that a cross-sectional area of a tapered portion between the central area of the bottom and the wall, which is molded by first press working, coincides with a cross-sectional area of a ridge portion of the molded product in which the punch-nose has the target sheet thickness, which is molded by second press working.

For example, the sandwiching width of the first punch and the setback amount of the second punch may be set to satisfy Formula (A) below.

[Math. 1]

$$\sqrt{(H_1^2+W_1^2)}\times t=(R_p+t)^2-\tfrac{1}{4}\pi R_p^2 \quad \text{(A)}$$

Here, $H_1$ is the setback amount of the second punch, $W_1$ is a length of the tapered portion in a width direction, Rp is a curvature radius of an inside of the punch-nose, and t is a sheet thickness of the work.

In the press-working apparatus, the molded product may be a long member in which the U-shaped portion forms a channel shape, or may be an axisymmetric member in which the U-shaped portion forms a cup shape. The punch-nose may be molded to have a larger sheet thickness than the wall and the bottom. An outside of the punch-nose may be molded to be substantially right-angled.

The press-working apparatus may further include a third punch that abuts against an end surface of the wall on an opposite side to the punch-nose, and is pressed toward the bottom surface after molding of the punch-nose.

According to another aspect of the present invention in order to achieve the above-mentioned object, there is provided a press-working method configured to provide a molded product by performing press working on a work, the molded product including, in a cross-section, a U-shaped portion including a bottom, a wall, and a punch-nose between the bottom and the wall, the press-working method including: a first press-working step of a first punch sandwiching a central area of the bottom with a bottom surface of a recessed portion of a die; and a second press-working step of a second punch being pushed into the recessed portion of the die later than the first punch, to restrain the wall between the second punch and a side surface of the recessed portion, and sandwich the work with the bottom surface to mold a peripheral area of the bottom and the punch-nose. A sandwiching width of the first punch that sandwiches the central area of the bottom and a setback amount of the second punch from the first punch in a push-in direction are set on the basis of a target sheet thickness of the punch-nose.

The work may have a flat plate shape at the time of starting the press working, and in the first press-working step, the first punch and the second punch may push the flat-plate-shaped work into the recessed portion while maintaining a state where the second punch is set back relative to the first punch, to mold the wall and the central area of the bottom.

In the second press-working step, the second punch may be pushed into the recessed portion, to sandwich the work with the bottom surface to mold the peripheral area of the bottom and the punch-nose.

The sandwiching width of the first punch and the setback amount of the second punch may be set in a manner that a cross-sectional area of a tapered portion between the central area of the bottom and the wall, which is molded by first press working, coincides with a cross-sectional area of a ridge portion of the molded product in which the punch-nose has the target sheet thickness, which is molded by second press working.

For example, the sandwiching width of the first punch and the setback amount of the second punch may be set to satisfy Formula (B) below.

[Math. 2]

$$\sqrt{(H_1^2+W_1^2)}\times t=(R_p+t)^2-\tfrac{1}{4}\pi R_p^2 \quad \text{(B)}$$

Here, $H_1$ is the setback amount of the second punch, $W_1$ is a length of the tapered portion in a width direction, Rp is a curvature radius of an inside of the punch-nose, and t is a sheet thickness of the work.

The press-working method may include a heating step of heating the work to a predetermined temperature before the first press-working step.

Furthermore, the press-working method may further include a receiving step of causing the recessed portion formed in the die to receive the U-shaped portion of the molded product before the first press-working step.

The press-working method may further include an additional molding step of, using the molded product including, in a cross-section, the U-shaped portion including the bottom, the wall, and the punch-nose as a second work, molding a second molded product by pushing in an end surface of the wall of the second work by a fifth punch in a state where the bottom of the second work is sandwiched by a second die and a fourth punch. The additional molding step may use a second press-working apparatus including the second die that has a shape corresponding to a shape of the second molded product, has a recessed portion to accommodate the second work, and supports at least the bottom of the second work, the fourth punch that sandwiches the bottom of the second work with the second die, and the fifth punch that pushes in the end surface of the wall of the second work to mold the second molded product.

Here, the recessed portion of the second die of the second press-working apparatus may be formed in a manner that a length between surfaces corresponding to the wall of the second work is larger than a length between outer surfaces of the wall of the second work, and in the additional molding step, the wall of the second work may be thickened by pushing in the end surface of the wall of the second work by the fifth punch in a state where the bottom of the second work is sandwiched by the second die and the fourth punch.

Alternatively, a portion of the second die of the second press-working apparatus that supports the bottom of the second work may include a fixed die that supports a central area and a movable die that supports an end and is movable in an extension direction of the wall, and in the additional molding step, a vertical wall extended portion extended from the wall may be formed by moving the movable die by pushing in the end surface of the wall of the second work by the fifth punch in a state where the bottom of the second work is sandwiched by the second die and the fourth punch.

In a portion of the second die of the second press-working apparatus that supports the wall of the second work, a step portion recessed in a direction going away from the wall may be formed at a position corresponding to the bottom of the second work, and in the additional molding step, a ceiling extended portion extended from the bottom may be formed by pushing in the end surface of the wall of the second work by the fifth punch in a state where the bottom of the second work is sandwiched by the second die and the fourth punch.

According to still another aspect of the present invention in order to achieve the above-mentioned object, there is provided a press-molded product molded by performing press working on a work, the press-molded product including, in a cross-section, a U-shaped portion including a bottom, a wall, and a punch-nose between the bottom and the wall. The punch-nose has a larger sheet thickness than the wall and the bottom. According to still another aspect of the present invention, there is provided a press-molded product molded by performing press working on a work, the press-molded product including, in a cross-section, a U-shaped portion including a bottom, a wall, and a punch-nose between the bottom and the wall. An outside of the punch-nose is substantially right-angled.

Here, a curvature radius R1 of an inside of the punch-nose, a curvature radius R2 of an outside of the punch-nose, and a sheet thickness t of the bottom and the wall of the work may satisfy a relation of Formula (C) below, $$R2 \leq R1+t \quad \text{(C)}$$

A hardness of the punch-nose of the press-molded product may be higher than a hardness of the work.

For example, the hardness of the punch-nose of the press-molded product may be 1.5 times or more as much as the hardness of the work.

The bottom of the press-molded product may include a central area, and a peripheral area between the central area and the punch-nose, the peripheral area being an area within a predetermined distance from the punch-nose, and a hardness of a boundary portion between the central area and the peripheral area may be higher than a hardness of the work and lower than a hardness of the punch-nose.

Here, the predetermined distance from the punch-nose may be decided on the basis of a sheet thickness of the work and a curvature radius of an inside of the punch-nose.

The central area of the bottom of the press-molded product may be an area molded by first press working, and the peripheral area of the bottom of the press-molded product may be an area molded by second press working after the first press working.

A sheet thickness of the wall of the press-molded product may be larger than a sheet thickness of the bottom.

The press-molded product may further include a vertical wall extended portion obtained by extending the wall.

Alternatively, the press-molded product may further include a ceiling extended portion obtained by extending the bottom.

Advantageous Effects of Invention

As described above, the present invention enables flexible molding of a punch-nose in press working for obtaining a molded product including a U-shaped portion in a cross-section.

DESCRIPTION OF EMBODIMENTS

Figure 1:
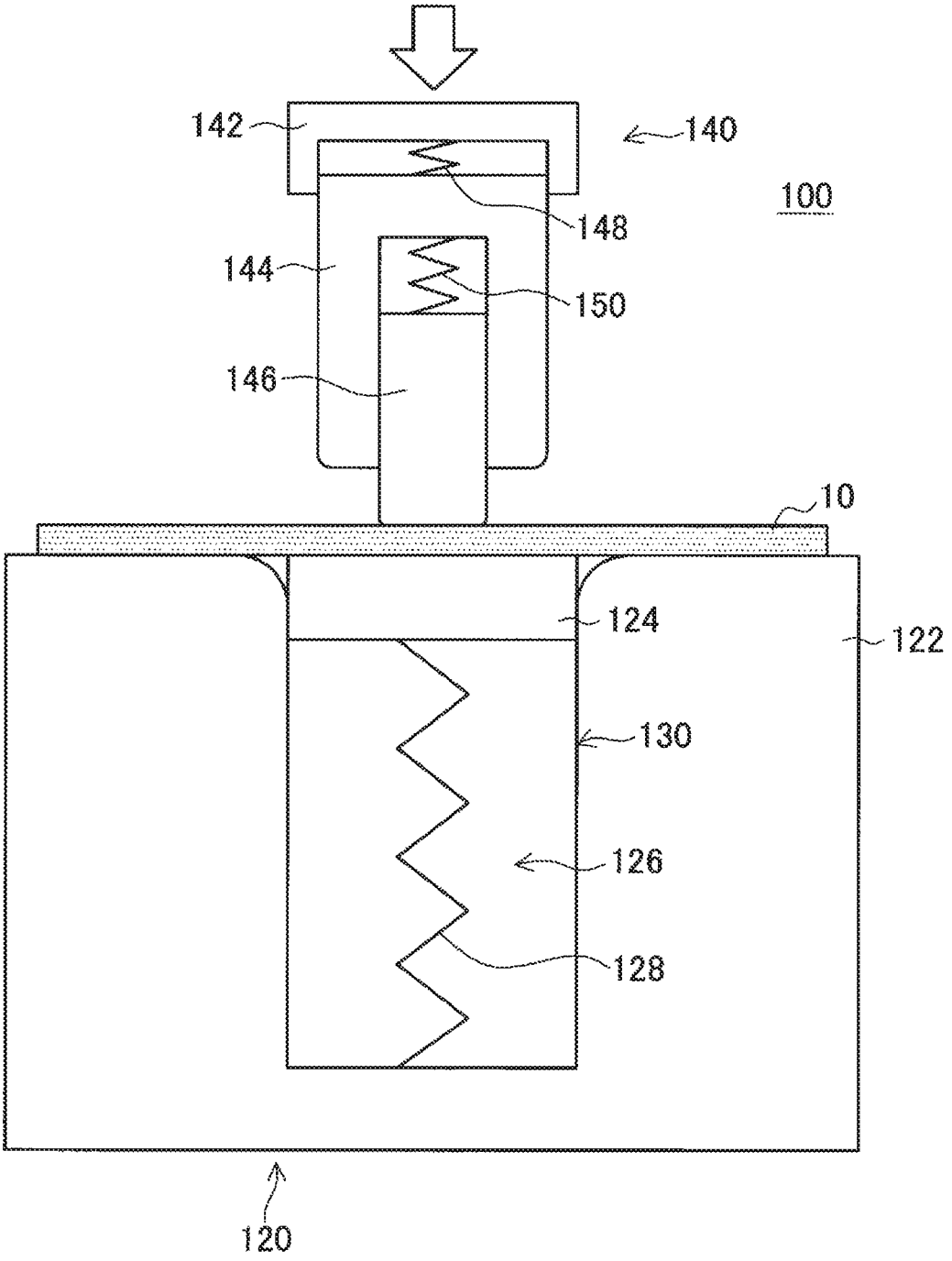
FIG. 1 is a schematic cross-sectional diagram illustrating a configuration of a press-working apparatus according to a first embodiment of the present invention, together with operation in press working.

Hereinafter, (a) preferred embodiment(s) of the present invention will be described in detail with reference to the appended drawings. In this specification and the appended drawings, structural elements that have substantially the same function and structure are denoted with the same reference numerals in the drawings, and repeated explanation of these structural elements is omitted in some cases.

1. First Embodiment: Thickening of Punch-Nose

1-1. Operation of Press-Working Apparatus

FIGS. 1 to 4 are schematic cross-sectional diagrams illustrating a configuration of a press-working apparatus according to a first embodiment of the present invention, together with operation in press working. According to FIGS. 1 to 4, a press-working apparatus 100 includes a die 120 and a punch 140. The die 120 includes a fixed die 122 and a movable die (pad) 124. The punch 140 includes a fixed punch 142, an outside movable punch (pad) 144, and an inside movable punch (pad) 146. That is, the punch 140 includes the inside movable punch 146 as a first punch, the outside movable punch 144 as a second punch, and the fixed punch 142 as a third punch.

As illustrated in FIG. 1, a work 10 has a flat plate shape at the time of starting press working in the present embodiment. The movable die 124 is supported by a cushion 128 linked to the bottom of a recessed portion 126 formed in the fixed die 122, in a manner that its upper surface abuts against the work 10. Meanwhile, in the punch 140, the inside movable punch 146 abuts against the center of the work 10, and sandwiches the work 10 with the upper surface of the movable die 124. The outside movable punch 144 is supported by a cushion 148 linked to the fixed punch 142 and a cushion 150 linked to the inside movable punch 146, at a position set back by a predetermined setback amount (i.e., farther from the work 10 and the die 120) relative to the inside movable punch 146.

After the start of press working, when the punch 140 is pressed toward the bottom surface of the recessed portion 126 (first pressing), the cushion 128 shrinks first, and the movable die 124 is pushed into the recessed portion 126 while sandwiching the center of the work 10 with the inside movable punch 146. At this point in time, the cushions 148 and 150 do not shrink; thus, the punch 140 is pushed into the recessed portion 126 in a state where the positional relation in which the outside movable punch 144 is set back relative to the inside movable punch 146 is maintained. In other words, the outside movable punch 144 is pushed into the recessed portion 126 later than the inside movable punch 146.

Figure 2:
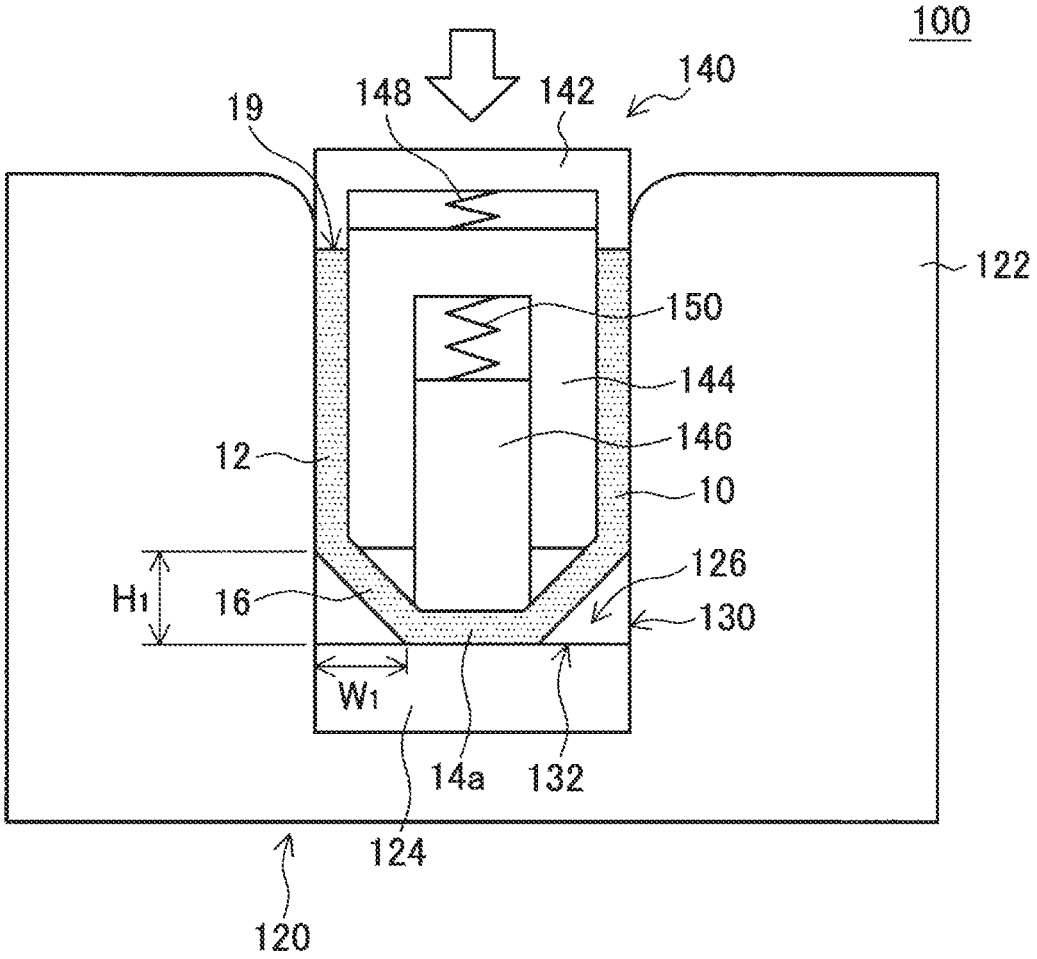
FIG. 2 is a schematic cross-sectional diagram illustrating a configuration of the press-working apparatus according to the first embodiment of the present invention, together with operation in press working.

As illustrated in FIG. 2, at the point in time when the movable die 124 hits the bottom of the recessed portion 126, the outline of a U-shaped portion is formed, in which the center of the work 10 that is pushed into the recessed portion 126 in a state of being sandwiched between the movable die 124 and the inside movable punch 146 serves as a bottom 14*a* (a central area of a bottom 14 that is finally formed), and the periphery of the work 10 that is tucked between the outside movable punch 144 and a side surface 130 of the recessed portion 126 accordingly serves as a wall 12.

Here, in the present embodiment, the wall 12 is restrained between the outside movable punch 144 and the side surface 130 of the recessed portion 126. In other words, in the press-working apparatus 100, the outside movable punch 144 is designed in a manner that its distance from the side surface 130 substantially coincides with the sheet thickness of the work 10. In addition, at the point in time when the movable die 124 pushed in by the inside movable punch 146 hits the bottom of the recessed portion 126, a tapered portion 16 is formed between the bottom 14*a* and the wall 12, because the outside movable punch 144 is pushed into the recessed portion 126 later than the inside movable punch 146.

Figure 3:
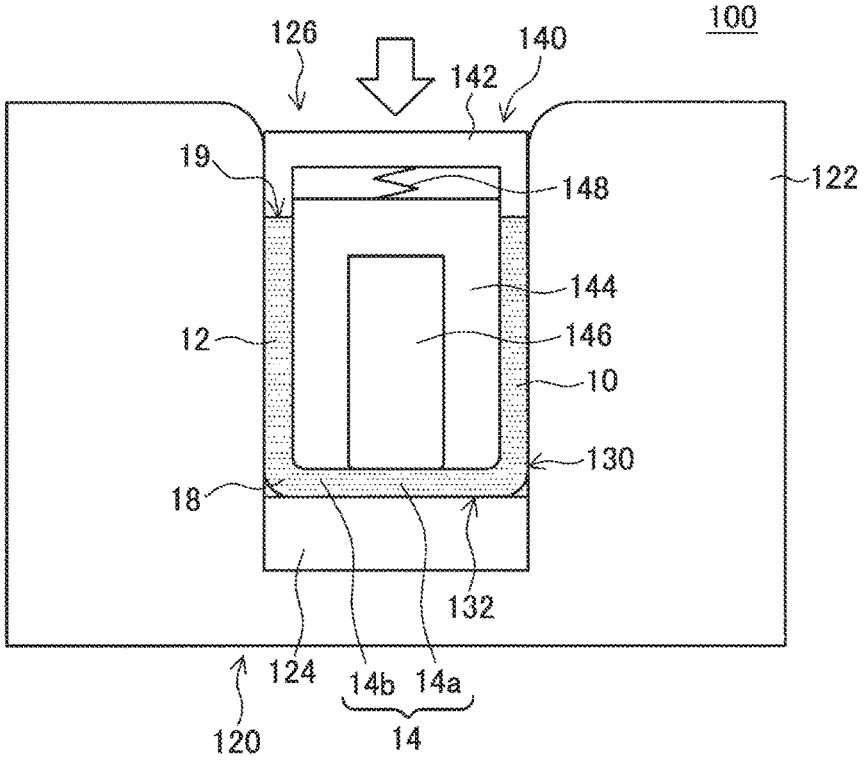
FIG. 3 is a schematic cross-sectional diagram illustrating a configuration of the press-working apparatus according to the first embodiment of the present invention, together with operation in press working.

As illustrated in FIG. 3, when the punch 140 is further pressed (second pressing), the cushion 150 shrinks this time, and the outside movable punch 144 is further pushed into the recessed portion 126 to catch up with the inside movable punch 146. At this time, the outside movable punch 144 sandwiches the work 10 (the tapered portion 16) with a bottom surface 132 to mold a bottom 14*b* (a peripheral area of the bottom) and a punch-nose 18 between the bottom 14 and the wall 12. Here, it is apparent from FIGS. 2 and 3 that in a cross-section of the work 10, the length of the tapered portion 16 is greater than the total length of the peripheral area 14*b* of the bottom and the punch-nose 18. Accordingly, in the press-working apparatus 100, the punch-nose 18 can be thickened, i.e., the punch-nose 18 can be molded to have a larger sheet thickness than the wall 12 and the bottom 14.

Figure 4:
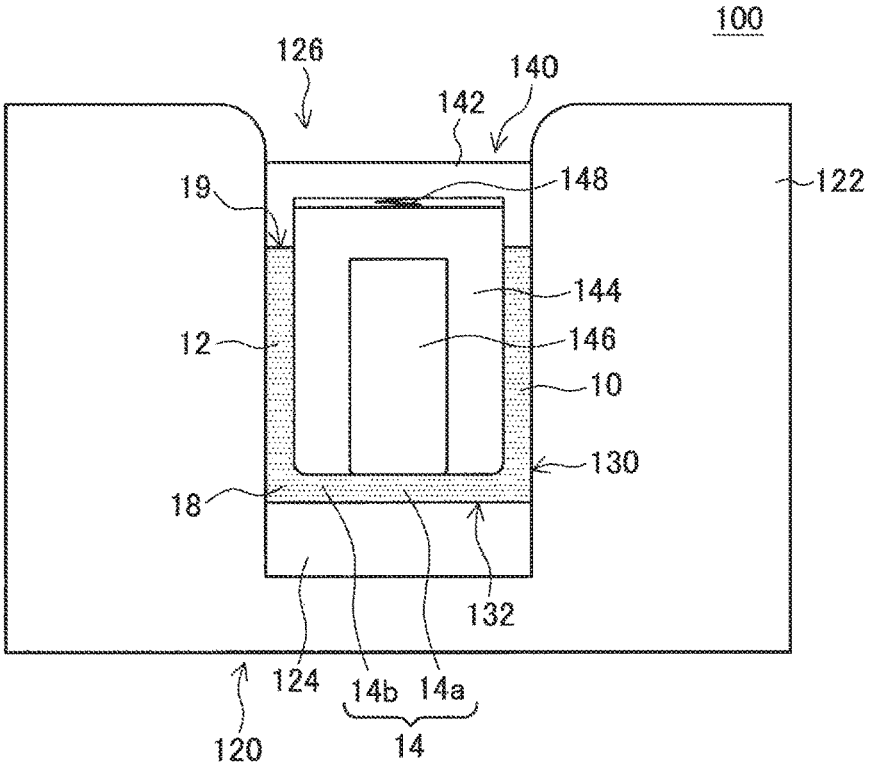
FIG. 4 is a schematic cross-sectional diagram illustrating a configuration of the press-working apparatus according to the first embodiment of the present invention, together with operation in press working.

As illustrated in FIG. 4, after this, the punch 140 may be further pressed toward the bottom surface 132 of the recessed portion 126 as an additional step. In this case, the cushion 148 shrinks, and the fixed punch 142 is pushed into the recessed portion 126. The fixed punch 142 abuts against an end surface 19 of the wall 12, and pushes the wall 12 into a space between the outside movable punch 144 and the side surface 130 to further thicken the punch-nose 18. Note that the end surface 19 is the surface of an end that is positioned on the opposite side to the punch-nose 18 among ends of the wall 12. In the example illustrated in the drawing, a space between the outside movable punch 144 and the side surface 130 and the bottom surface 132 is filled by the fixed punch 142 pushing in the wall 12, and the outside of the punch-nose 18 is molded to be substantially right-angled.

In the press-working apparatus 100 to perform working on the work 10 in this manner, working is performed in a manner that the length of the tapered portion 16 formed by the first pressing is greater than the total length of the peripheral area 14*b* of the bottom and the punch-nose 18; thus, the punch-nose 18 is molded to have a larger sheet thickness than the wall 12 and the bottom 14. Hence, it is necessary to appropriately set the sandwiching width of the upper surface of the inside movable punch 146 that sandwiches the central area 14*a* of the bottom 14 of the work 10, and the setback amount of the outside movable punch 144 from the inside movable punch 146 in the push-in direction, which determine the length of the tapered portion 16. Specifically, in order for the punch-nose 18 to be molded to have a larger sheet thickness than the wall 12 and the bottom 14, the amount of the work that constitutes the tapered portion 16 is equal to or more than the amount of the work that is needed for the punch-nose 18 to have a target sheet thickness. That is, if a cross-sectional area of the tapered portion 16 is equal to or more than a cross-sectional area of a portion including the punch-nose 18 (corresponding to a ridge portion described later) that is formed from the tapered portion 16, the punch-nose 18 can have the target sheet thickness or more.

Figure 5:
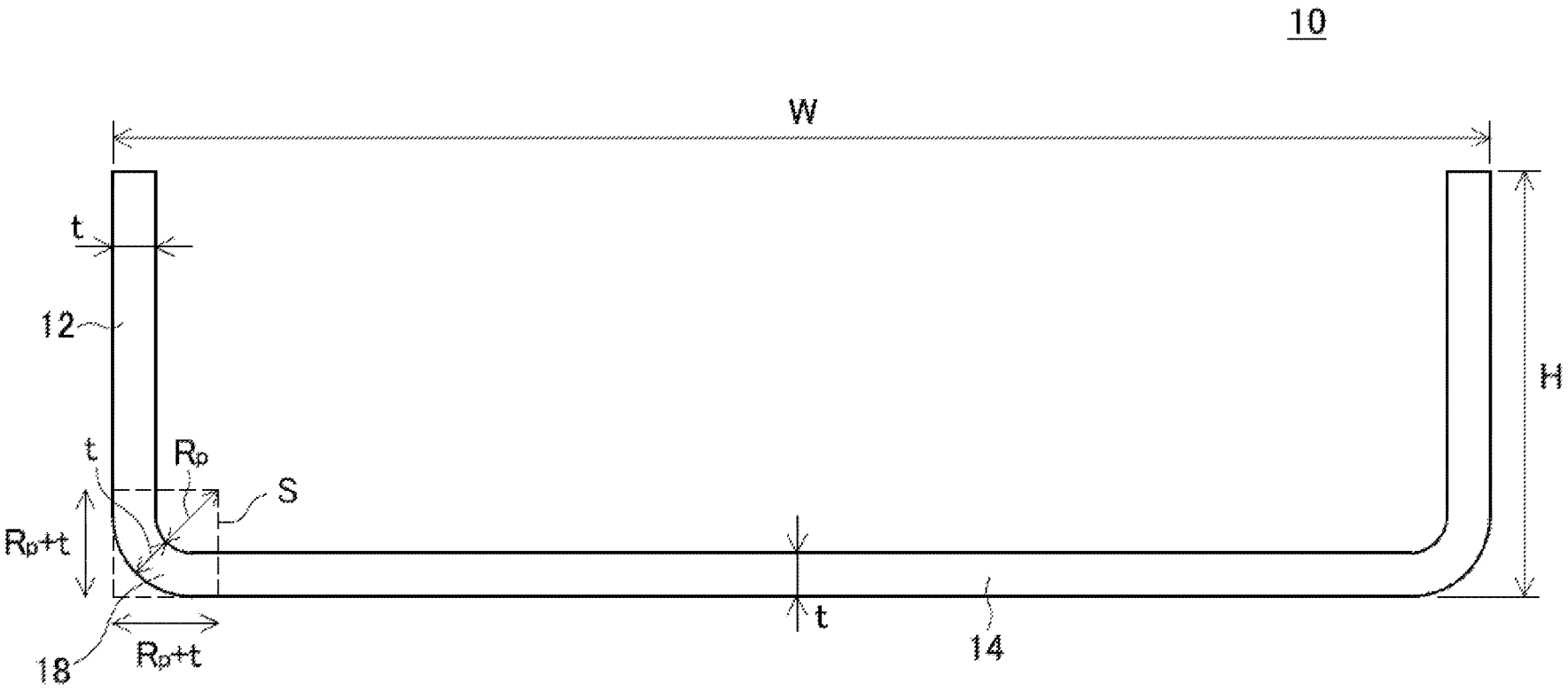
FIG. 5 is a diagram for describing dimensions related to the shape of a work after second pressing.

First, the cross-sectional area of the portion including the punch-nose 18 that is formed from the tapered portion 16 is calculated in the following manner. For description, FIG. 5 illustrates an example of the work 10 after the second pressing illustrated in FIG. 3. FIG. 5 is a diagram for describing dimensions related to the shape of the work 10 after the second pressing.

As illustrated in FIG. 5, the work 10 after the second pressing includes the wall 12, the bottom 14, and the punch-nose 18. The work 10 is assumed to have a sheet thickness t at all positions. A curvature radius of the inside of the punch-nose 18 is denoted by $R_p$, and a curvature radius of the outside of the punch-nose 18 is denoted by $R_p$+t. Then, a square area S that includes the punch-nose 18 and shares the outside of the wall 12 and the outside of the bottom 14 of the work 10 is set. A length of one side of the area S is assumed to be the sum of the sheet thickness t and the curvature radius $R_p$. That is, the area S includes ¼ of each of a circle with a radius of $R_p$+t and a circle with a radius of $R_p$. Hereinafter, a portion of the work 10 that falls within the area S is also referred to as a ridge portion.

A cross-sectional area $S_A$ of the ridge portion illustrated in FIG. 5 is expressed by Formula (1) below. The cross-sectional area $S_A$ of the ridge portion in Formula (1) represents the cross-sectional area of one ridge portion, and in FIG. 5, for example, represents the cross-sectional area of one of the left and right ridge portions.

[Math. 3]

$$S_A = \tfrac{1}{4}\{\pi(R_p+t)^2 - \pi R_p^2\} \quad (1)$$

In the case of making the outside of the punch-nose 18 right-angled, a cross-sectional area $S_B$ of the ridge portion of the work 10 is expressed by Formula (2) below.

[Math. 4]

$$S_B = (R_p+t)^2 - \tfrac{1}{4}\pi R_p^2 \quad (2)$$

Meanwhile, a cross-sectional area $S_T$ of the tapered portion 16 is expressed by Formula (3) below, where the length of the tapered portion 16 in the push-in direction is denoted by $H_1$ and the length of the tapered portion 16 in the width direction is denoted by $W_1$ as illustrated in FIG. 2. The cross-sectional area $S_T$ of the tapered portion 16 in Formula (3) represents the cross-sectional area of one tapered portion 16, and in FIG. 2, for example, represents the cross-sectional area of one of the left and right tapered portions 16.

[Math. 5]

$$S_T = \sqrt{(H_1^2 + W_1^2)} \times t \quad (3)$$

According to the above description, if the cross-sectional area $S_T$ of the tapered portion 16 is at least equal to or more than the cross-sectional area $S_A$ expressed in Formula (1) above, the sheet thickness of the punch-nose 18 does not decrease from the sheet thickness of the work 10. In addition, to make the outside of the punch-nose 18 substantially right-angled, the cross-sectional area $S_T$ of the tapered portion 16 is made equal to the cross-sectional area $S_B$ expressed in Formula (2) above. In this manner, the cross-sectional area $S_T$ of the tapered portion 16 may be set in accordance with the target sheet thickness of the punch-nose 18.

In the press-working apparatus 100, the length $H_1$ of the tapered portion 16 in the push-in direction, which determines the cross-sectional area $S_T$ of the tapered portion 16, corresponds to the setback amount of the outside movable punch 144 from the inside movable punch 146 in the push-in direction of the press-working apparatus 100. In addition, the length $W_1$ of the tapered portion 16 in the width direction, which determines the cross-sectional area $S_T$ of the tapered portion 16, corresponds to ½ of a difference between the width of the recessed portion 126 of the fixed die 122 and the width of the upper surface of the inside movable punch 146. The width of the upper surface of the inside movable punch 146 is the sandwiching width to sandwich the central area 14*a* of the bottom 14. The width of the recessed portion 126 of the fixed die 122 is decided as a size of a molded product; hence, the length $W_1$ of the tapered portion 16 in the width direction is adjusted in accordance with the width of the upper surface of the inside movable punch 146.

Therefore, the cross-sectional area $S_T$ of the tapered portion 16 can be set to a predetermined size by adjusting the setback amount of the outside movable punch 144 from the inside movable punch 146 in the push-in direction of the press-working apparatus 100 and the width of the upper surface of the inside movable punch 146 (i.e., the sandwiching width). Hence, the cross-sectional area $S_T$ of the tapered portion 16 is decided on the basis of the target sheet thickness of the punch-nose 18, and the press-working apparatus 100 is configured in a manner that the tapered portion 16 having the decided cross-sectional area $S_T$ is obtained; thus, a molded product in which the punch-nose 18 is thickened can be obtained.

1-2. Characteristic of Molded Product

Figure 6A:
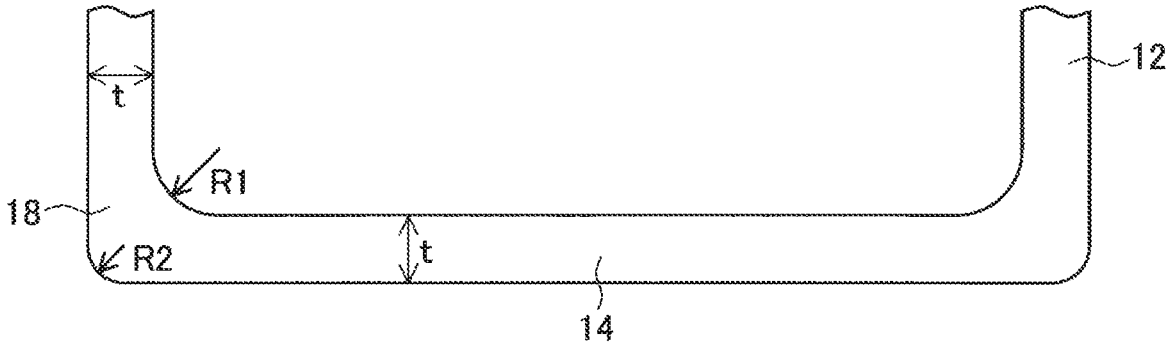
FIG. 6A is a diagram for describing an example of the shape of a punch-nose in a cross-section of a molded product molded by the press-working apparatus according to the first embodiment of the present invention.
Figure 6B:
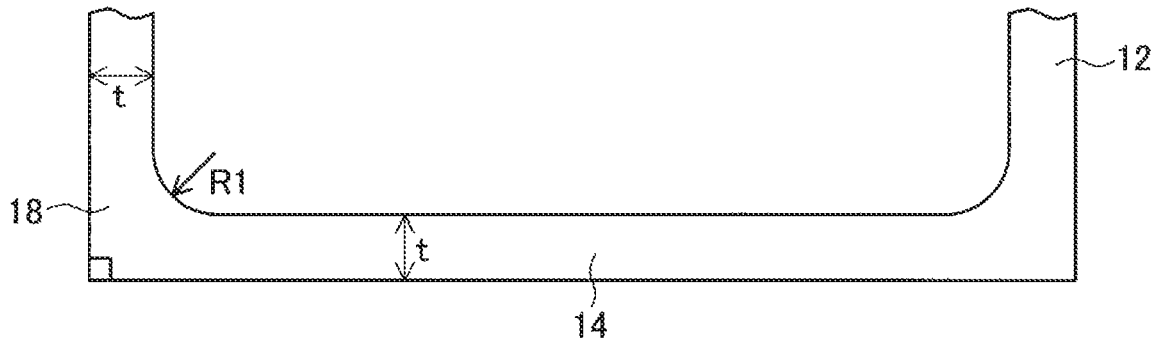
FIG. 6B is a diagram for describing an example of the shape of a punch-nose in a cross-section of a molded product molded by the press-working apparatus according to the first embodiment of the present invention.

FIGS. 6A and 6B are diagrams for describing examples of the shape of a punch-nose in a cross-section of a molded product molded by the press-working apparatus according to the first embodiment of the present invention. FIG. 6A is an example in which the punch-nose 18 is molded to have a larger sheet thickness than the wall 12 and the bottom 14. FIG. 6B is an example in which the outside of the punch-nose 18 is molded to be substantially right-angled.

As already described, in the conventional technology, a material is caused to flow between the wall and the bottom by making the outside of the punch-nose have a large curvature radius, to thicken the entire U-shaped portion in a cross-section. In this case, if the outside of the punch-nose has a small curvature radius, flow of the material is inhibited, which causes flaws such as a fold mark. In contrast, in the present embodiment, after the wall 12 and the central area of the bottom 14 are molded, the outside movable punch 144 crushes the tapered portion 16 to mold the punch-nose 18; thus, flow of material does not occur between the wall 12 and the bottom 14, and accordingly it is possible to make the outside of the punch-nose 18 have a small curvature radius or make the outside of the punch-nose 18 substantially right-angled.

As described above, in the example illustrated in FIG. 6A, the punch-nose 18 of the work 10 is molded to have a larger sheet thickness than the wall 12 and the bottom 14. In other words, in this example, the punch-nose 18 is thickened. In this case, in a cross-section of the work 10, a curvature radius R2 of the outside of the punch-nose 18 is smaller than the sum of a curvature radius R1 of the inside and the sheet thickness t of the wall 12 and the bottom 14 (R2<R1+t). As in the illustrated example, it is also possible to make the outside curvature radius R2 smaller than the inside curvature radius R1 (R2<R1). Note that in the case where the punch-nose 18 has the same sheet thickness as the wall 12 and the bottom 14, R2=R1+t. In the case where the punch-nose 18 has a smaller sheet thickness than the wall 12 and the bottom 14, R2>R1+t. Accordingly, thickening of the punch-nose 18 is equivalent to the curvature radius R2 of the outside of the punch-nose 18 being smaller than the sum of the curvature radius R1 of the inside and the sheet thickness t.

As a specific example, in the case where the sheet thickness t of the wall 12 and the bottom 14 of the work 10 is 5 mm, the curvature radius R2 of the outside of the punch-nose 18 is set to 0.5 mm (10% of the sheet thickness t), and the curvature radius R1 of the inside is set to 7.5 mm (1.5 times the sheet thickness t); thus, press working can be performed without causing flaws. Note that since the outside of the punch-nose 18 can be right-angled as in the example illustrated in FIG. 6B, the curvature radius R2 may be smaller than 0.5 mm. In addition, although the present embodiment is significantly advantageous in the case where the curvature radius R2 is made small in the relationship with the conventional technology described above, application of the present embodiment is not inhibited by the curvature radius R2 of the outside of the punch-nose 18 being large; thus, the curvature radius R2 may be larger than 0.5 mm. If the curvature radius R1 of the inside of the punch-nose 18 is too large with respect to the curvature radius R2, flaws due to folding of the material or the like may occur; however, in the case where the curvature radius R1 is at least within the range in the above example with respect to the sheet thickness t, press working can be performed without causing flaws.

On the other hand, in the example illustrated in FIG. 6B, the outside of the punch-nose 18 is molded to be substantially right-angled in a cross-section of the work 10. Note that in this specification, a case where "the outside of the punch-nose 18 is substantially right-angled" includes not only a case where the outside of the punch-nose 18 is strictly right-angled but also a case where the curvature radius of the outside of the punch-nose 18 is very small and close to zero. In this case, also the inside of the punch-nose 18 can be molded to be substantially right-angled, but it is desirable to provide the inside of the punch-nose 18 with some curvature radius R1 (not close to zero) in terms of avoiding stress concentration on the punch-nose 18. In this case, the curvature radius of the outside of the punch-nose 18 can be regarded as being smaller than the sum of the curvature radius R1 of the inside and the sheet thickness t. Accordingly, also in the example illustrated in FIG. 6B, it can be said that the punch-nose 18 is thickened.

Figure 7:
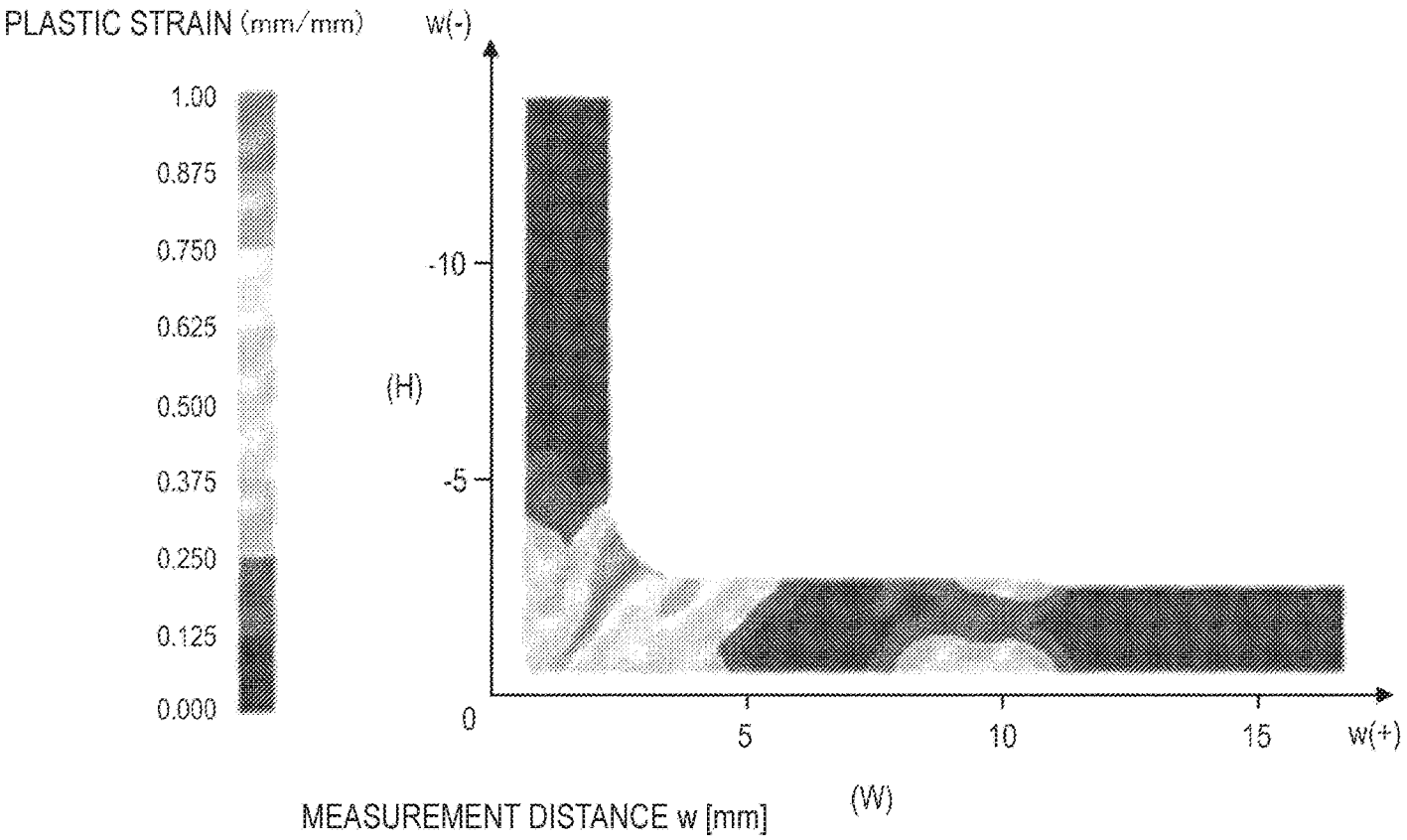
FIG. 7 shows plastic strain distribution for a punch-nose and part of a bottom of a work molded by press working.
Figure 8:
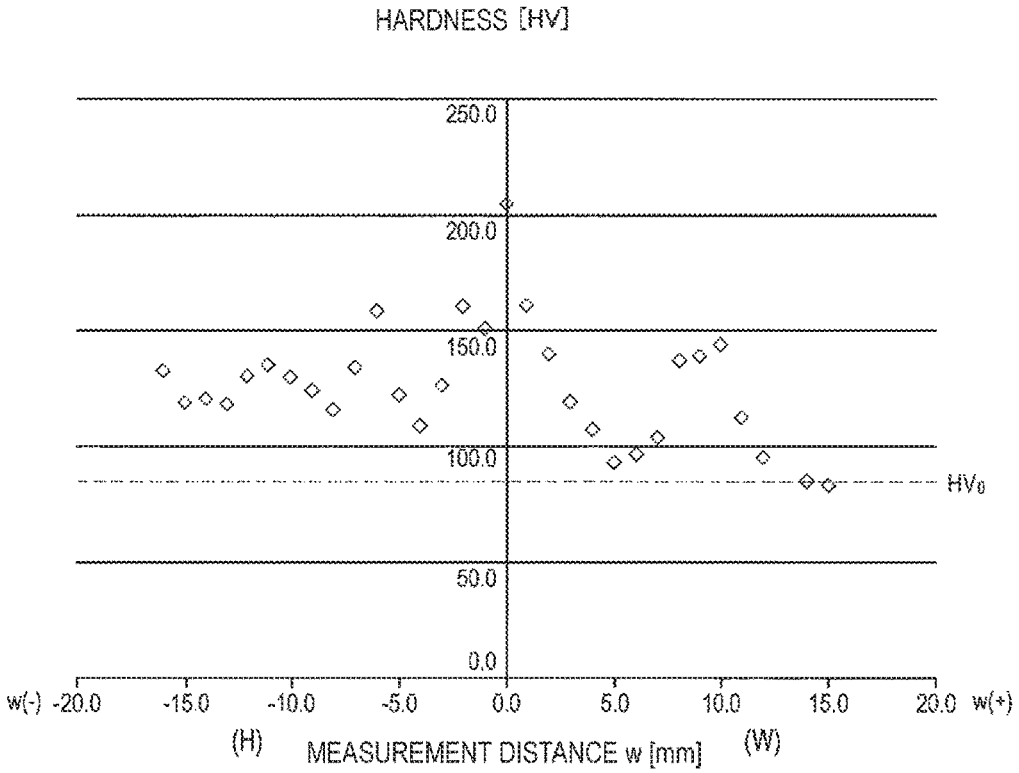
FIG. 8 is a graph showing hardness distribution of the work shown in FIG. 7.

In addition, in a work molded by the press-working apparatus according to the present embodiment, a punch-nose is harder than other portions. As an example, FIGS. 7 and 8 show results of measuring hardness distribution of a wall, a punch-nose, and a bottom when a 270 MPa-grade steel sheet was subjected to press working using the press-working apparatus according to the present embodiment. FIG. 7 shows plastic strain distribution for the punch-nose and part of the bottom of the work molded by press working. FIG. 8 is a graph showing hardness distribution of the work shown in FIG. 7. In FIG. 8, hardness at a position of 200 μm in the thickness direction from the outer surface of the work was measured every 1 mm from the punch-nose toward the wall and the bottom. Hardness is expressed in Vickers hardness, and larger values indicate higher hardness. A measurement distance w expresses the bottom direction by a positive value, and expresses the wall direction by a negative value, using the position of the punch-nose as the origin point.

The thickness before press working of the work of this example was 1.6 mm, and a hardness (hereinafter also referred to as "material hardness") $HV_0$ thereof was 85. A tapered portion formed by the first press working had a length in the width direction of 10 mm and a length in the push-in direction of 10 mm. Then, after the punch-nose and a peripheral area of the bottom were molded by the second press working, hardness at a position of 200 μm in the thickness direction from the outer surface of the work was measured every 1 mm from the punch-nose toward the wall and the bottom.

The plastic strain distribution shown in FIG. 7 demonstrates that strain is large in the punch-nose and part of the bottom. In addition, according to the hardness distribution of the work, as shown in FIG. 8, hardness at the origin-point position expressing the punch-nose is higher than in other portions. Hardness becomes lower from the origin-point position toward the bottom side, but hardness becomes high again at a position of a measurement distance of approximately 10 mm. Thus, in the work molded by the press-working apparatus according to the present embodiment, hardness is higher than the material hardness in the punch-nose and in the bottom at a position away from the punch-nose by a predetermined distance. It is presumed that at these positions, an increase in plastic strain has resulted in greater work hardening.

As shown in FIG. 8, in this example, the material hardness $HV_0$ was 85, whereas the hardness in the punch-nose (measurement distance w=0) was 212, which is approximately 2.5 times the material hardness $HV_0$. The hardness of the bottom at a position 10 mm away from the punch-nose (measurement distance w=10 mm) was 127, which is approximately 1.5 times the material hardness $HV_0$. Thus, hardness is high in the punch-nose and in the bottom at a position away from the punch-nose by a predetermined distance. In addition, the hardness of the punch-nose is higher than that of the bottom at the position away from the punch-nose by the predetermined distance. Here, the bottom at the position away from the punch-nose by the predetermined distance corresponds to a boundary portion between the peripheral area and the central area of the bottom.

More specifically, the bottom at the position away from the punch-nose by the predetermined distance corresponds to a bottom-side end area of the tapered portion, which is adjacent to a portion sandwiched by the inside movable punch in the recessed portion of the die by the first press working. The central area of the bottom is sandwiched by the first press working and therefore substantially maintains the hardness of the material hardness $HV_0$, whereas the bottom-side end area of the tapered portion is not sandwiched by the first press working. Therefore, it is presumed that work hardening is caused in the bottom-side end area of the tapered portion by the second press working performed after the first press working. Consequently, the work molded by the press-working apparatus according to the present embodiment has the hardness distribution shown in FIG. 8.

For comparison, if a punch-nose is molded by performing press working once, for example, stress is concentrated on the punch-nose, and plastic strain occurs only in the punch-nose. In contrast, when the punch-nose is molded by multi-step press working as in the press-working apparatus according to the present embodiment, the central area of the bottom can substantially maintain the hardness of the material hardness $HV_0$ in the first press working, and furthermore, a load in the second press working after the first press working can be easily dispersed throughout the tapered portion molded in the first press working. This suppresses concentration of stress on the punch-nose molded from the tapered portion, and also reduces a load in molding the punch-nose and the peripheral area of the bottom from the tapered portion.

Although the work of this example is a 270 MPa-grade steel sheet and is soft steel with high work hardenability, also a steel sheet with low work hardenability, such as a high-tensile steel sheet, similarly exhibits a tendency of hardness being high in the punch-nose and in the bottom at a position away from the punch-nose by a predetermined distance. In this case, a rate of increase in hardness in the tapered portion and in the bottom at the position away from the punch-nose by the predetermined distance is lower than that in soft steel as in this example. Specifically, the hardness in the punch-nose is approximately 1.5 times the material hardness $HV_0$, and the hardness in the bottom at the position away from the punch-nose by the predetermined distance is approximately 1.1 times the material hardness $HV_0$.

Figure 9A:
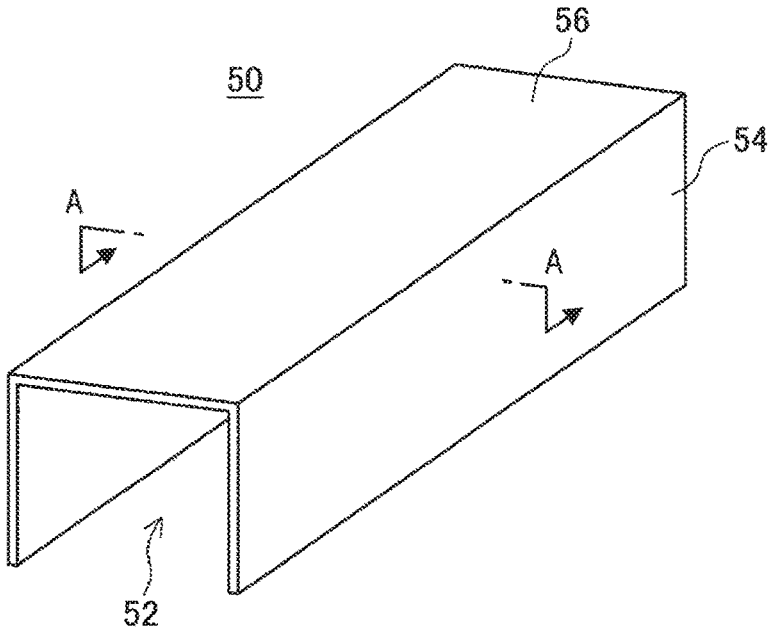
FIG. 9A illustrates an example of a molded product in the first embodiment of the present invention.
Figure 9B:
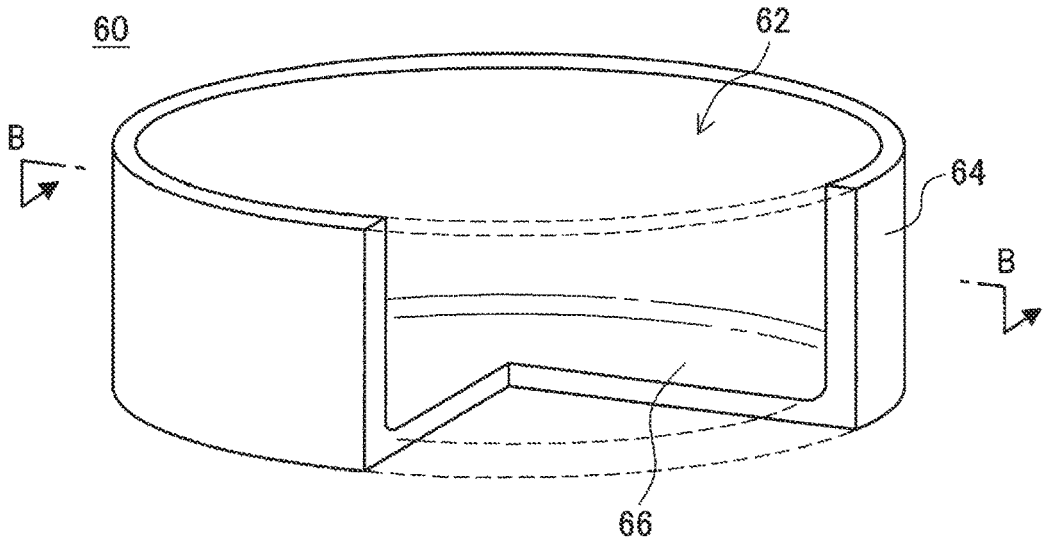
FIG. 9B illustrates an example of a molded product in the first embodiment of the present invention.

FIGS. 9A and 9B illustrate examples of molded products in the present embodiment. A long molded product 50 illustrated in the example of FIG. 9A includes a channel shape 52. The channel shape 52 includes a wall 54 and a bottom 56. In this example, a cross-section of the work 10 (including a U-shaped portion) illustrated in FIGS. 3 and 4 corresponds to A-A cross-section of the molded product 50 illustrated in FIG. 9A. In addition, in the case of this example, in the press-working apparatus 100, the recessed portion 126 formed in the die 120 forms a groove, and bending of the work 10 is performed using the die 120 and the punch 140.

On the other hand, an axisymmetric-shaped molded product 60 illustrated in the example of FIG. 9B includes a cup shape 62. The cup shape 62 includes a wall 64 and a bottom 66. In this example, a cross-section of the work 10 (including a U-shaped portion) illustrated in FIGS. 3 and 4 corresponds to B-B cross-section of the molded product 60 illustrated in FIG. 9B. In addition, in the case of this example, in the press-working apparatus 100, the recessed portion 126 formed in the die 120 forms a hole, and drawing of the work 10 is performed using the die 120 and the punch 140.

The molded products 50 and 60 described above both are molded products that are molded by press working and include a U-shaped portion in a cross-section. These molded products exhibit, for example, a characteristic of a punch-nose of the U-shaped portion being thickened or the outside of the punch-nose being substantially right-angled, as described above. Note that, although details will be described later, particularly in the case where the molded product has a cup shape, thinning may occur in the punch-nose in a step of molding the U-shaped portion in the cross-section. When thinning is suppressed by applying the present embodiment in such a case, the curvature radius of the outside of the punch-nose of the molded product may be equal to or smaller than the sum of the curvature radius of the inside and the sheet thickness.

1-3. Modification Examples

Figure 10:
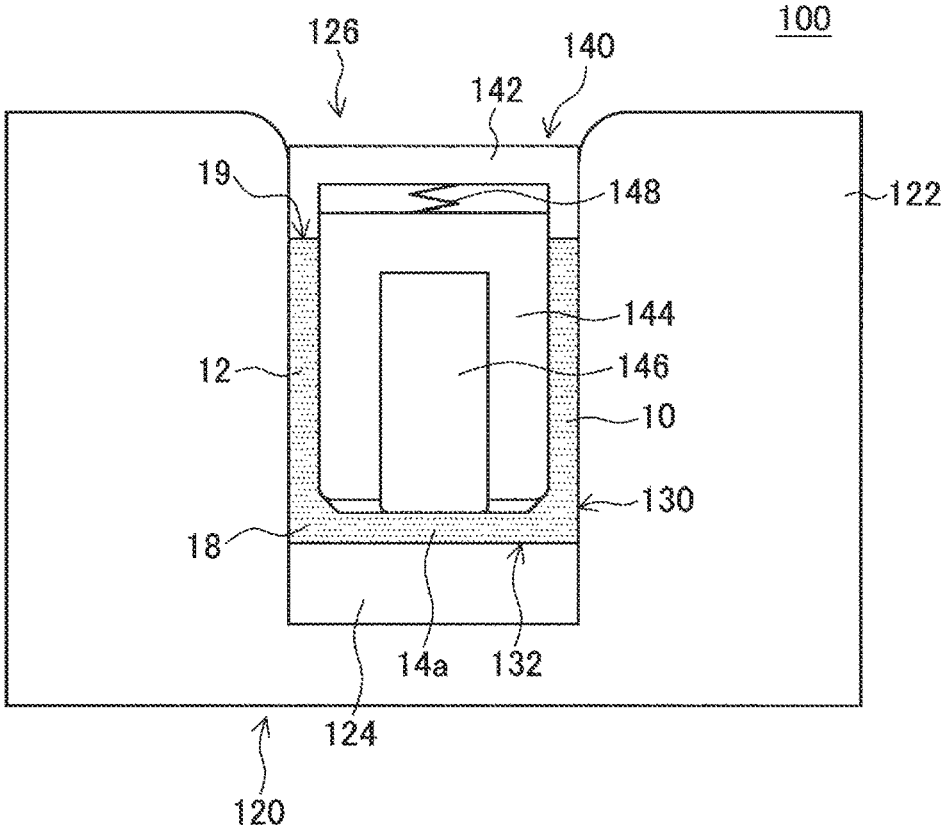
FIG. 10 is a schematic cross-sectional diagram illustrating the operation of a press-working apparatus according to a modification example of the first embodiment of the present invention.
Figure 11:
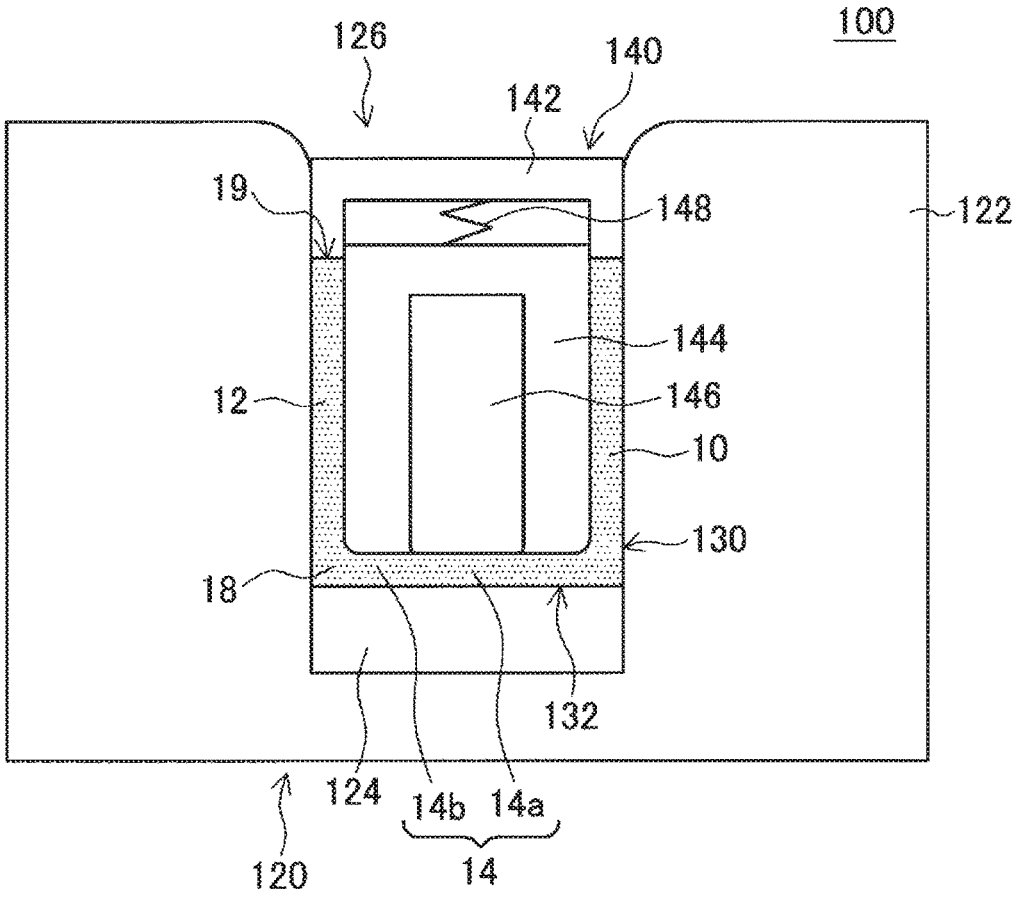
FIG. 11 is a schematic cross-sectional diagram illustrating the operation of the press-working apparatus according to the modification example of the first embodiment of the present invention.

FIGS. 10 and 11 are schematic cross-sectional diagrams illustrating the operation of a press-working apparatus according to a modification example of the first embodiment of the present invention. In the present modification example, the wall 12 and the bottom 14*a* that constitute a U-shaped portion in a cross-section of the work 10 are molded by a step similar to that described with reference to FIGS. 1 and 2 (this step already described is not illustrated). Then, the punch 140 is further pressed toward the bottom surface 132, and the cushion 150 shrinks; thus, the outside movable punch 144 is further pushed into the recessed portion 126. At this time, the outside movable punch 144 catches up with the inside movable punch 146 that already sandwiches the bottom 14*a* with the bottom surface 132; in the present modification example, before the outside movable punch 144 catches up with the inside movable punch 146, the outside of the punch-nose 18 formed by expanding the tapered portion 16 of the work 10 closely contacts the side surface 130 and the bottom surface 132 of the recessed portion 126, to be substantially right-angled, as illustrated in FIG. 10.

After this, when the punch 140 is further pressed toward the bottom surface 132, the inside of the punch-nose 18 is expanded by the outside movable punch 144; thus, the wall 12 is pushed out upward. At this time, the fixed punch 142 is pushed up by the end surface 19 of the wall 12 to be set back with respect to the outside movable punch 144. In other words, in the present modification example, the action of the fixed punch 142 with respect to the end surface 19 is opposite to that in the example illustrated in FIG. 4. Consequently, as illustrated in FIG. 11, the inside of the punch-nose 18 is molded along the outside movable punch 144, and molding of the work 10 is completed.

In the present modification example, the length of the tapered portion 16 is adjusted by setting a difference in position between the outside movable punch 144 and the inside movable punch 146 at the time of starting press working (the initial length of the cushion 150), for example, and the outside of the punch-nose 18 is molded to be substantially right-angled, without performing additional pressing by the fixed punch 142 as in the example illustrated in FIG. 4. In this case, in the course of pressing by the outside movable punch 144, the wall 12 may be pushed up by a material in excess in the punch-nose 18. In such a case, as described above, the end surface 19 can be molded precisely by allowing the rise of the wall 12 while pressing the end surface 19 with the fixed punch 142.

Figure 12:
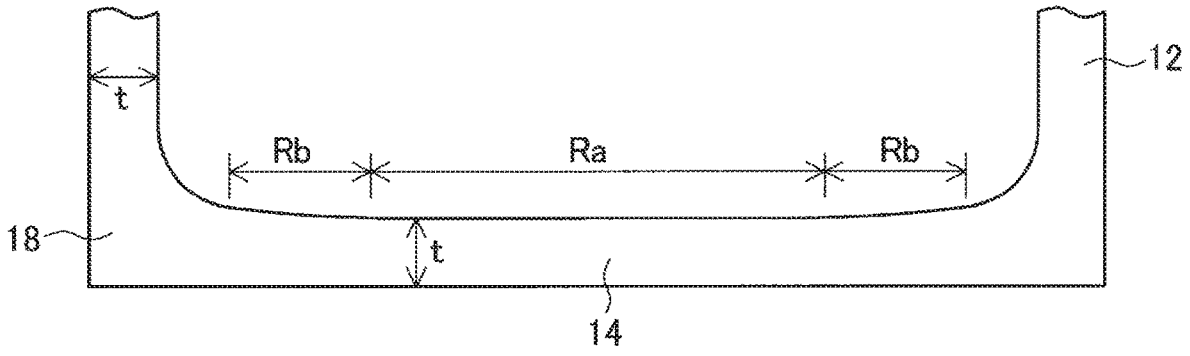
FIG. 12 is a diagram for describing an example of a cross-sectional shape of a molded product molded by a press-working apparatus according to another modification example of the first embodiment of the present invention.

FIG. 12 is a diagram for describing an example of a cross-sectional shape of a molded product molded by a press-working apparatus according to another modification example of the present embodiment. In the example illustrated in FIG. 12, a lower surface of the outside movable punch 144 is tapered toward the outside of the punch 140; thus, an area Rb other than a central area Ra of the bottom 14 of the work 10 molded by the outside movable punch 144 is gradually thickened from the central area Ra toward the punch-nose 18. In this case, a change in sheet thickness between the bottom 14 and the punch-nose 18 is less steep, which mitigates stress concentration on the punch-nose 18.

1-4. Conclusion

In the first embodiment of the present invention described above, in press-working of the work 10 using the press-working apparatus 100, the outside movable punch 144 is pushed into the recessed portion 126 later than the inside movable punch 146; thus, the tapered portion 16 is formed between the wall 12 and the bottom 14*a*. Since the length of the tapered portion 16 is greater than the total length of the peripheral area 14*b* of the bottom and the punch-nose 18 that are finally formed, by molding the punch-nose 18 by expanding the tapered portion 16, the punch-nose 18 can be thickened without causing material to flow between the wall 12 and the bottom 14. Therefore, in the present embodiment, it is possible to make the outside of the punch-nose 18 have a small curvature radius as compared with a conventional technology or make the outside of the punch-nose 18 substantially right-angled. In addition, it is possible to thicken only the punch-nose 18 without thickening the wall 12 and the bottom 14.

In the press-working apparatus 100 according to the present embodiment, in a series of pressing steps of pushing in the punch 140, the action of the cushion 150 causes the outside movable punch 144 to be pushed into the recessed portion 126 later than the inside movable punch 146. This allows flexible molding of the punch-nose 18. Accordingly, the press-working apparatus 100 may be uniaxial, and there is no need for a multi-axial press-working apparatus in which a plurality of portions of a punch are pressed independently of each other.

Although press working is started from a state where the work 10 has a flat plate shape as illustrated in FIG. 1 in the above-described example, the present embodiment is not limited to this example. For example, a step of molding the wall 12 and the bottom 14*a* (central area) that form a U-shaped portion of the work 10 may be performed as primary molding in another apparatus, and as subsequent secondary molding, press working may be started from a state where the U-shaped portion in the cross-section of the work 10 is received in the recessed portion 126 as illustrated in FIG. 2, for example, in the press-working apparatus 100. In such a case, the movable die 124 is not necessarily provided. In addition, the present embodiment is also applicable to press working for obtaining a molded product whose cross-section has a hat-shaped portion further including a flange portion continuous to an end of the wall 12 (an end on the opposite side to the punch-nose 18).

1-5. Supplement: Case where Outside of Punch-Nose is Provided with Curvature As another modification example of the first embodiment of the present invention, for example, a corner surface may be formed between a side surface and a bottom surface in a recessed portion formed in a die. By molding a work along this corner surface, the outside of a punch-nose between a wall and a bottom can be worked precisely into a shape with curvature. Hereinafter, description will be given on press-molding in a case where the outside of the punch-nose is provided with curvature. Note that other points are similar to those in the first embodiment, and therefore repeated explanation is omitted.

Figure 13:
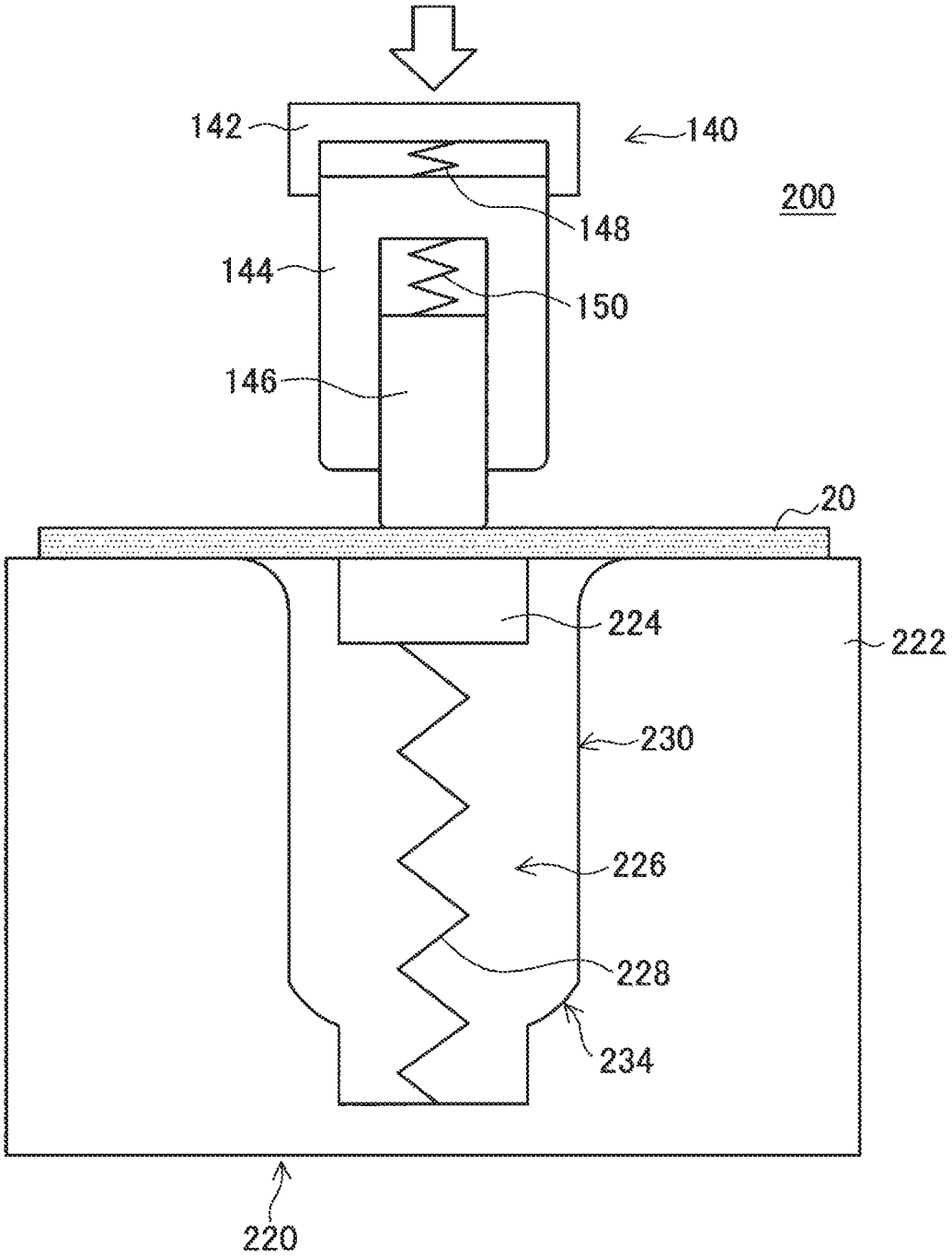
FIG. 13 is a schematic cross-sectional diagram illustrating a configuration of a press-working apparatus according to another modification example of the first embodiment of the present invention, together with operation in press working.
Figure 14:
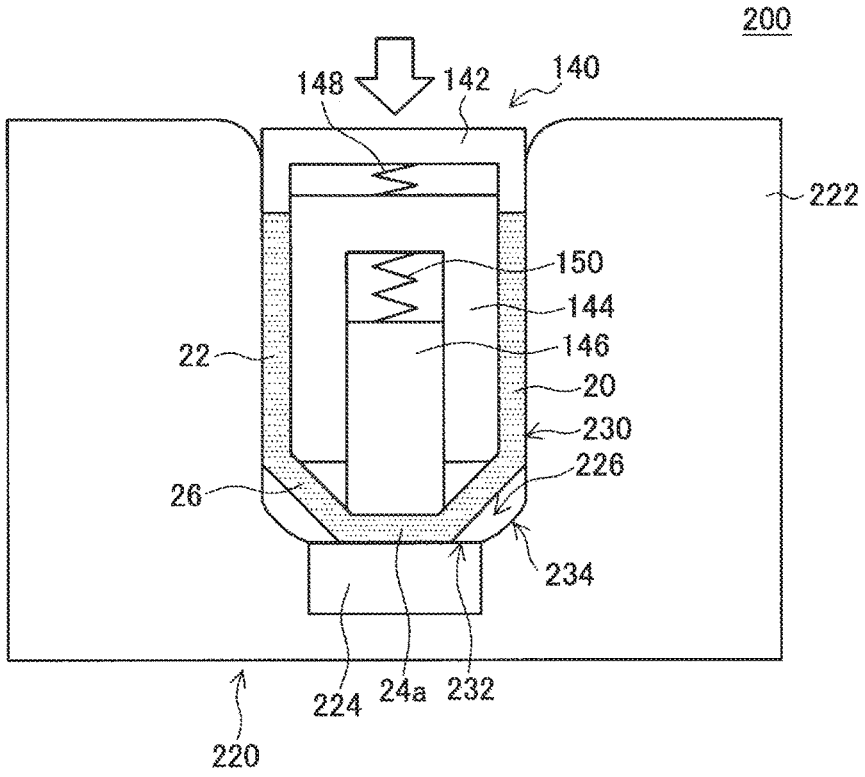
FIG. 14 is a schematic cross-sectional diagram illustrating a configuration of the press-working apparatus according to the other modification example of the first embodiment of the present invention, together with operation in press working.
Figure 15:
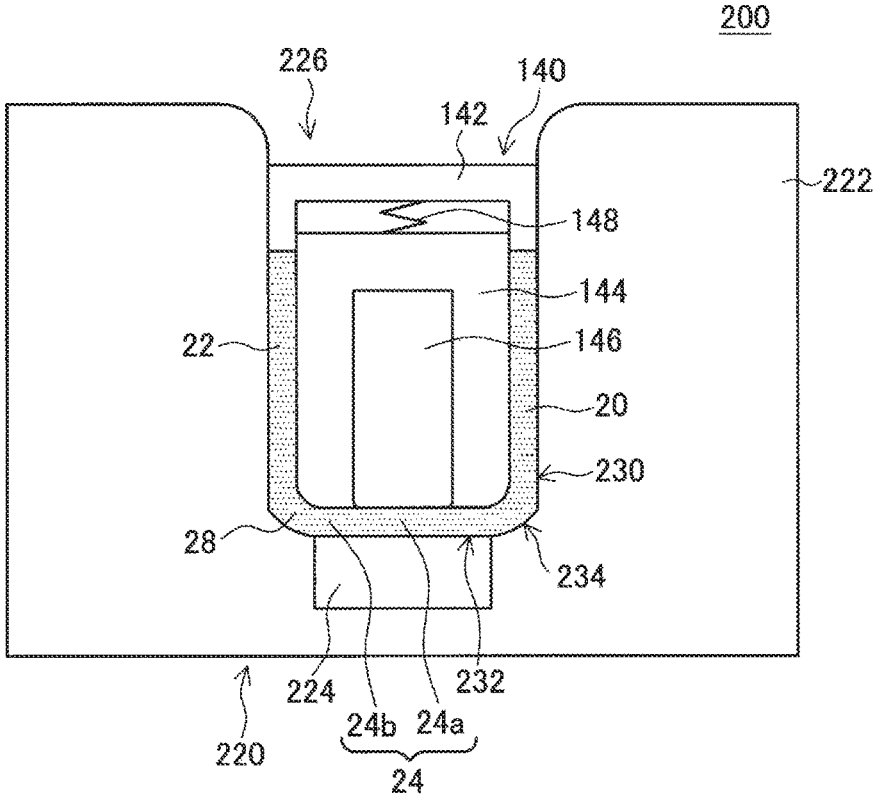
FIG. 15 is a schematic cross-sectional diagram illustrating a configuration of the press-working apparatus according to the other modification example of the first embodiment of the present invention, together with operation in press working.

FIGS. 13 to 15 are schematic cross-sectional diagrams illustrating a configuration of a press-working apparatus according to the other modification example of the first embodiment of the present invention, together with operation in press working. According to FIGS. 13 to 15, a press-working apparatus 200 includes a die 220 and the punch 140. The die 220 includes a fixed die 222 and a movable die (pad) 224. Note that the configuration of the punch 140 is similar to that in the first embodiment.

As illustrated in FIG. 13, a work 20 has a flat plate shape at the time of starting press working in the present embodiment. The movable die 224 is supported by a cushion 228 linked to the bottom of a recessed portion 226 formed in the fixed die 222, in a manner that its upper surface abuts against the work 20. Meanwhile, in the punch 140, as in the first embodiment, the inside movable punch 146 abuts against the center of the work 20, and sandwiches the work 20 with the upper surface of the movable die 224. The outside movable punch 144 is supported at a position set back relative to the inside movable punch 146.

After the start of press working, when the punch 140 is pressed toward the bottom surface of the recessed portion 226, the cushion 228 shrinks first, and the movable die 224 is pushed into the recessed portion 226 while sandwiching the center of the work 20 with the inside movable punch 146. As in the first embodiment, the punch 140 is pushed into the recessed portion 126 in a state where the positional relation in which the outside movable punch 144 is set back relative to the inside movable punch 146 is maintained. Accordingly, the outside movable punch 144 is pushed into the recessed portion 226 later than the inside movable punch 146.

As illustrated in FIG. 14, at the point in time when the movable die 224 hits the bottom of the recessed portion 226, the outline of a U-shaped portion is formed, in which the center of the work 20 that is pushed into the recessed portion 226 in a state of being sandwiched between the movable die 224 and the inside movable punch 146 serves as a bottom 24*a* (a central area of a bottom 24 that is finally formed), and the periphery of the work 20 that is tucked between the outside movable punch 144 and a side surface 230 of the recessed portion 226 accordingly serves as a wall 22.

Here, as a difference from the first embodiment, in the present embodiment, a corner surface 234 with curvature is present between a bottom surface 232 and the side surface 230 of the recessed portion 226. The bottom surface 232 is formed by the movable die 224 that has hit the bottom, and the side surface 230 and the corner surface 234 are formed by the fixed die 222. Accordingly, in the present embodiment, an outer dimension of the movable die 224 is smaller than an inner dimension of the recessed portion 226 by a dimension of the corner surface 234. Also in the present embodiment, a tapered portion 26 is formed by the outside movable punch 144 being pushed into the recessed portion 226 later than the inside movable punch 146; the tapered portion 26 is not in contact with the corner surface 234.

As illustrated in FIG. 15, when the punch 140 is further pressed, the cushion 150 shrinks this time, and the outside movable punch 144 is further pushed into the recessed portion 226 to catch up with the inside movable punch 146. At this time, the outside movable punch 144 sandwiches the work 20 (the tapered portion 26) with the bottom surface 232 and the corner surface 234 to mold a bottom 24*b* (a peripheral area of the bottom) and a punch-nose 28. The inside of the punch-nose 28 is molded along the outside movable punch 144, and the outside is molded along the corner surface 234 of the recessed portion 226. Since the corner surface 234 has curvature, also the outside of the punch-nose 28 is molded into a shape with curvature.

Also in the present embodiment, it is apparent from FIGS. 14 and 15 that in a cross-section of the work 20, the length of the tapered portion 26 is greater than the total length of the bottom 24*b* and the punch-nose 28. Accordingly, in the press-working apparatus 200, the punch-nose 28 can be thickened as in the first embodiment. In this case, as already described, in a cross-section of the work 20, a curvature radius R2 of the outside of the punch-nose 28 is smaller than the sum of a curvature radius R1 of the inside and the sheet thickness t of the wall 22 and the bottom 24 ($R2<R1+t$). It is also possible to make the outside curvature radius R2 smaller than the inside curvature radius R1 ($R2<R1$). Note that also in the present embodiment, in the case where thinning of the punch-nose 28 is suppressed, the curvature radii of the punch-nose 28 may satisfy $R2>R1+t$, as in the first embodiment.

A molded product molded by the press-working apparatus 200 according to the present embodiment has the same characteristic as the molded product in the first embodiment, except that, in a cross-section, the outside of a punch-nose is molded into a shape with curvature as described above. In other words, a molded product of the present embodiment exhibits a characteristic of a punch-nose being thickened as in the example illustrated in FIG. 6A in the first embodiment, for example. At this time, a wall and a bottom are not necessarily thickened. Alternatively, a molded product of the present embodiment exhibits a characteristic of thinning in a punch-nose, which occurs in a conventional technology, being suppressed.

In addition, the shape of a molded product in the present embodiment may be a long shape (in which a U-shaped portion forms a channel shape) as illustrated in FIG. 9A in the first embodiment, for example, or may be an axisymmetric shape (in which a U-shaped portion forms a cup shape). Like the first embodiment, the present embodiment is also applicable to press working for obtaining a molded product whose cross-section has a hat-shaped portion further including a flange portion continuous to an end of the wall 22.

In the other modification example of the first embodiment of the present invention described above, in press-working of the work 20 using the press-working apparatus 200, the outside movable punch 144 is pushed into the recessed portion 226 later than the inside movable punch 146, and thus the tapered portion 26 is formed, as in the first embodiment. Since the length of the tapered portion 26 is greater than the total length of the bottom 24*b* and the punch-nose 28 that are finally formed, by molding the punch-nose 28 by expanding the tapered portion 26, the punch-nose 28 can be thickened without causing material to flow between the wall 22 and the bottom 24. In the present embodiment, since the corner surface 234 is formed in the recessed portion 226, the outside of the punch-nose 28 can be stably molded into a shape with curvature; since there is no need to cause a material to flow between the wall 22 and the bottom 24 as described above, the curvature radius of the outside of the punch-nose 28, which is determined by the corner surface 234, can be made smaller than that in a conventional technology, for example. Also in the present embodiment, the press-working apparatus 200 may be uniaxial as in the first embodiment.

Also in the present embodiment, press working in the press-working apparatus 200 is not necessarily started from a state where the work 20 has a flat plate shape as illustrated in FIG. 13, and for example, primary molding of the work 20 may be performed in another apparatus, as in the first embodiment. In this case, as secondary molding, press working is started from a state where the U-shaped portion in the cross-section of the work 20 is received in the recessed portion 226 as illustrated in FIG. 14, in the press-working apparatus 200. In such a case, the press-working apparatus 200 need not be provided with the movable die 224.

2. Second Embodiment: Deep Drawing

Next, a second embodiment of the present invention is described. In the present embodiment, so-called deep drawing is performed to obtain an axisymmetric-shaped molded product that includes a cup shape formed by a U-shaped portion in a cross-section. In the following description, deep drawing according to the present embodiment and advantages thereof are described in comparison with deep drawing according to a conventional technology. Note that as already described, the first embodiment can also be applied to deep drawing for obtaining an axisymmetric-shaped molded product that includes a cup shape. In other words, even without additional description, a configuration similar to that in the first embodiment can be adopted in the deep drawing in the present embodiment. Similarly, in the case of applying the first embodiment to deep drawing, a configuration similar to that in the present embodiment can be adopted.

Figure 16:
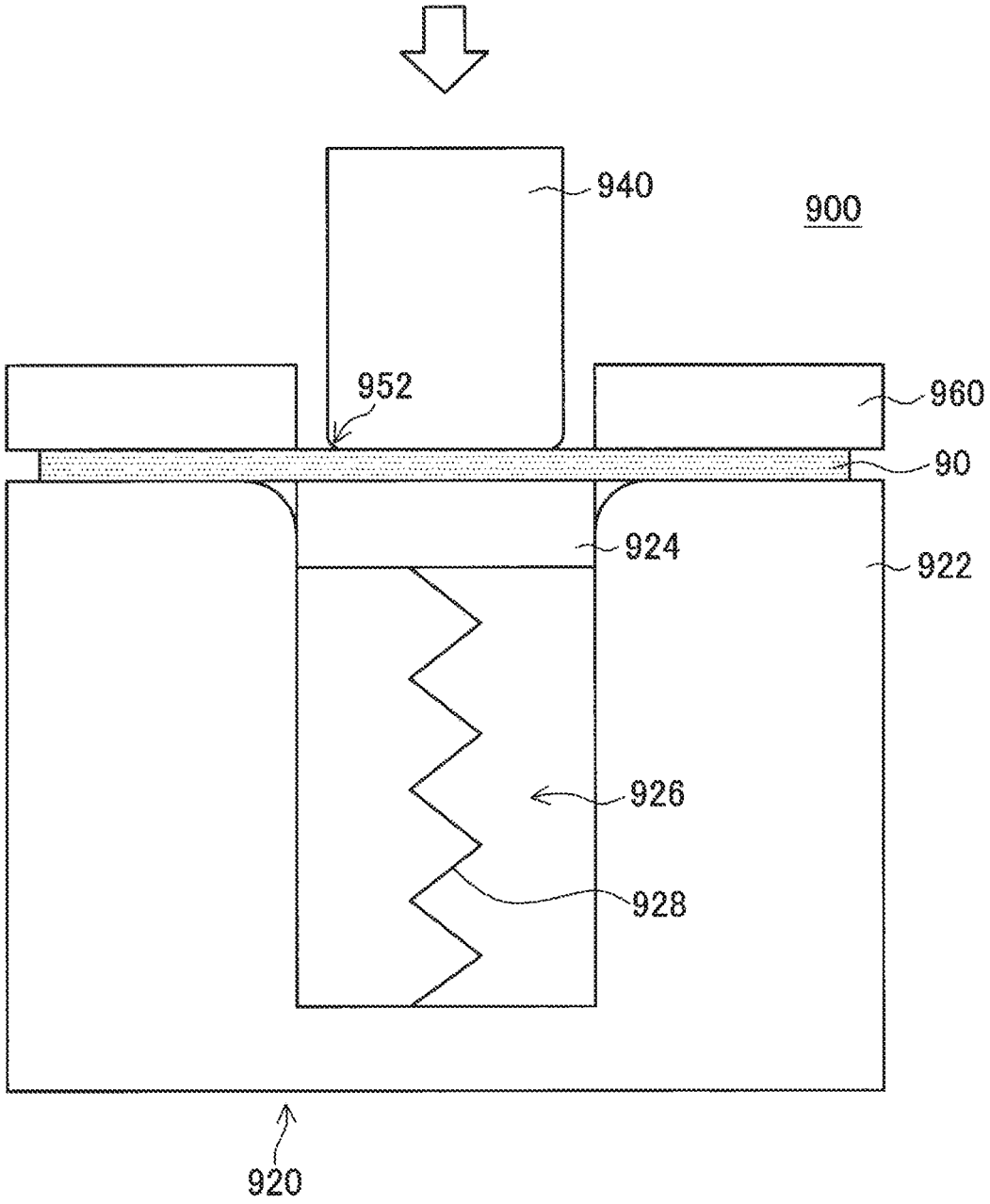
FIG. 16 is a schematic cross-sectional diagram illustrating a configuration of a press-working apparatus according to a conventional technology, together with operation in deep drawing.
Figure 17:
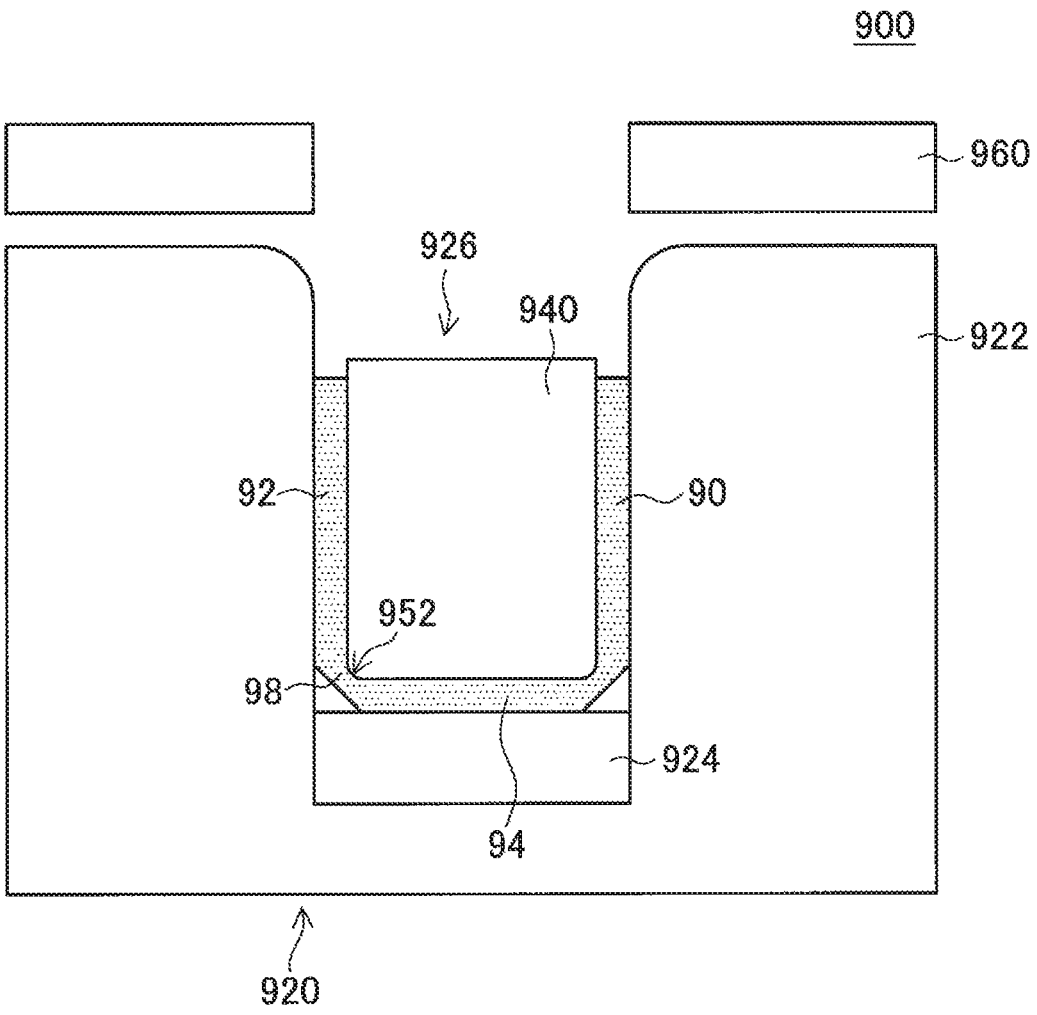
FIG. 17 is a schematic cross-sectional diagram illustrating a configuration of the press-working apparatus according to the conventional technology, together with operation in deep drawing.

FIGS. 16 and 17 are schematic cross-sectional diagrams illustrating a configuration of a press-working apparatus according to a conventional technology, together with operation in deep drawing. According to FIGS. 16 and 17, a press-working apparatus 900 that performs deep drawing of a work 90 includes a die 920, a punch 940, and a blank holder 960. The die 920 includes a fixed die 922, and a movable die (pad) 924 linked by a cushion 928. Unlike in the present embodiment, the punch 940 is a single block. When the punch 940 is pressed from the state illustrated in FIG. 16, the flat-plate-shaped work 90 is pushed into a recessed portion 926 formed in the fixed die 922. Thus, a U-shaped portion in a cross-section is molded as illustrated in FIG. 17. At this time, the blank holder 960 restrains a peripheral portion of the work 90 between the blank holder 960 and an upper surface of the fixed die 922, to suppress occurrence of a wrinkle.

In the conventional technology, a punch-nose 98 between a wall 92 and a bottom 94 is simply bent by a shoulder portion 952 of the punch 940; thus, a difference in perimeter between the outside and the inside makes the punch-nose 98 have a smaller sheet thickness than the wall 92 and the bottom 94 (the punch-nose 98 is thinned). Such thinning is significant in the case where the curvature radius of the inside of the punch-nose 98 is made small in a cross-section, for example. The occurrence of thinning in the punch-nose 98 is generally unpreferable, because higher strength is required of the punch-nose 98 rather than the wall 92 and the bottom 94 in some cases.

In deep drawing in the present embodiment, the above-described problem of thinning of a punch-nose in the conventional technology is improved.

Figure 18:
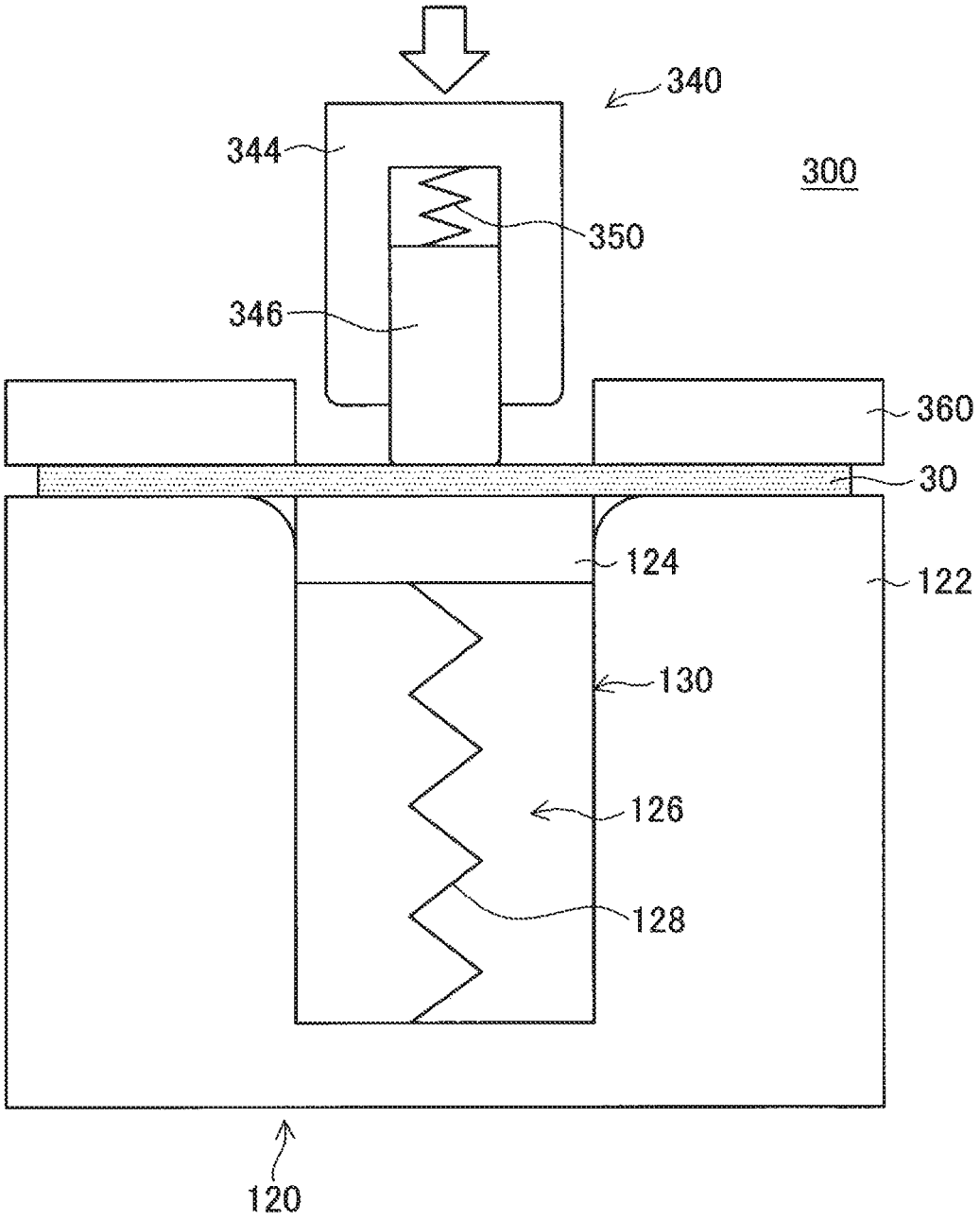
FIG. 18 is a schematic cross-sectional diagram illustrating a configuration of a press-working apparatus according to a second embodiment of the present invention, together with operation in press working (deep drawing).
Figure 19:
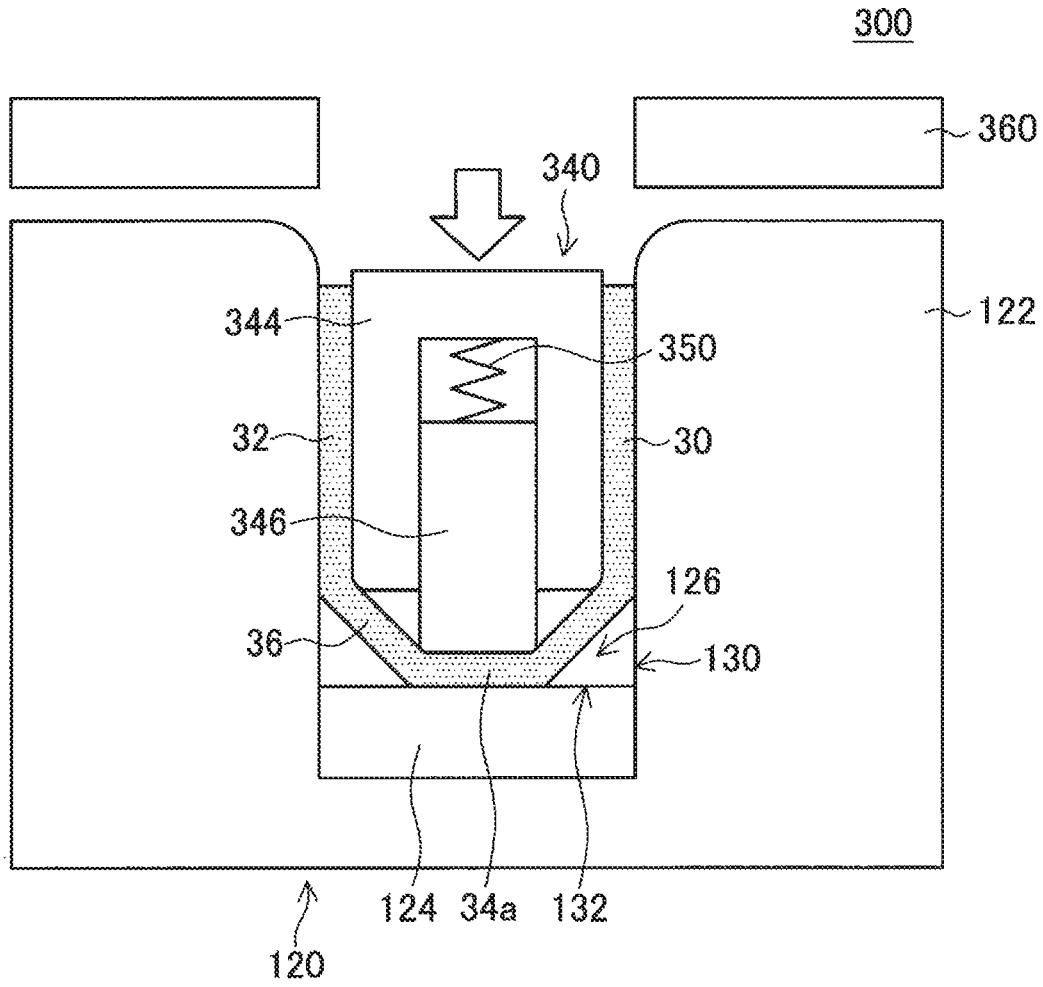
FIG. 19 is a schematic cross-sectional diagram illustrating a configuration of the press-working apparatus according to the second embodiment of the present invention, together with operation in press working (deep drawing).
Figure 20:
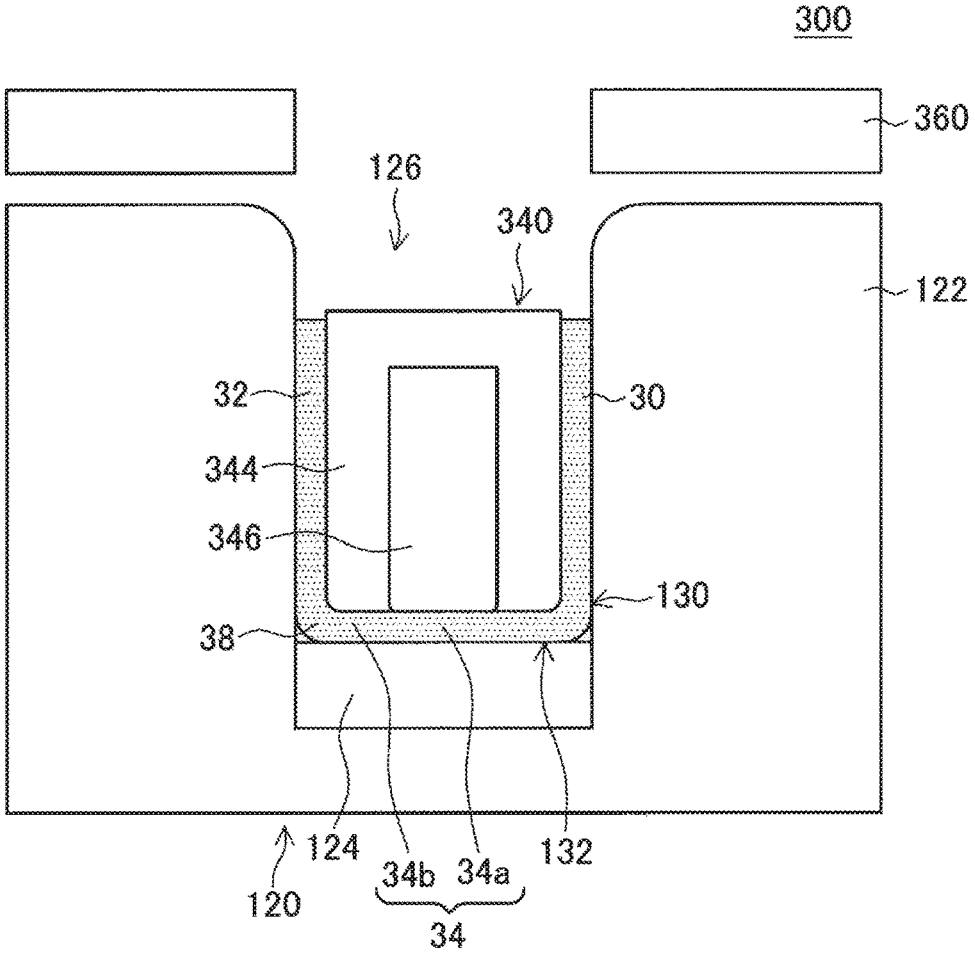
FIG. 20 is a schematic cross-sectional diagram illustrating a configuration of the press-working apparatus according to the second embodiment of the present invention, together with operation in press working (deep drawing).

FIGS. 18 to 20 are schematic cross-sectional diagrams illustrating a configuration of a press-working apparatus according to the second embodiment of the present invention, together with operation in press working (deep drawing). According to FIGS. 18 to 20, a press-working apparatus 300 includes the die 120, a punch 340, and a blank holder 360. The punch 340 includes a fixed punch 344 and a movable punch (pad) 346. Note that the configuration of the die 120 is similar to that in the first embodiment.

As illustrated in FIG. 18, a work 30 has a flat plate shape at the time of starting press working in the present embodiment. As in the first embodiment, the movable die 124 is supported in a manner that its upper surface abuts against the work 30. Meanwhile, in the punch 340, the movable punch 346 abuts against the center of the work 30, and sandwiches the work 30 with the upper surface of the movable die 124. A cushion 350 is present between the fixed punch 344 and the movable punch 346, and a positional relation in which the fixed punch 344 is set back relative to the movable punch 346 is maintained.

After the start of press working, when the punch 340 is pressed toward the bottom surface of the recessed portion 126, the cushion 128 shrinks first, and the movable die 124 is pushed into the recessed portion 126. At this point in time, the cushion 350 does not shrink; thus, the punch 340 is pushed into the recessed portion 126 in a state where the positional relation in which the fixed punch 344 is set back relative to the movable punch 346 is maintained. In other words, the fixed punch 344 is pushed into the recessed portion 126 later than the movable punch 346. At this time, the blank holder 360 restrains a peripheral portion of the work 30 between the blank holder 360 and an upper surface of the fixed die 122, to suppress occurrence of a wrinkle. Note that such a blank holder may be provided similarly in performing deep drawing in the configuration of the first embodiment, for example.

As illustrated in FIG. 19, at the point in time when the movable die 124 hits the bottom of the recessed portion 126, the outline of a U-shaped portion is formed, in which the center of the work 30 that is pushed into the recessed portion 126 in a state of being sandwiched between the movable die 124 and the movable punch 346 serves as a bottom 34*a* (a central area of a bottom 34 that is finally formed), and the periphery of the work 30 that is tucked between the fixed punch 344 and the side surface 130 of the recessed portion 126 accordingly serves as a wall 32. At this point in time, a tapered portion 36 is formed between the bottom 34*a* and the wall 32, because the fixed punch 344 is pushed into the recessed portion 126 later than the movable punch 346.

As illustrated in FIG. 20, when the punch 340 is further pressed, the cushion 350 shrinks this time, and the fixed punch 344 is further pushed into the recessed portion 126 to catch up with the movable punch 346. At this time, the fixed punch 344 sandwiches the work 30 (the tapered portion 36) with the bottom surface 132 of the recessed portion 126 to mold a bottom 34*b* (a peripheral area of the bottom) and a punch-nose 38. It is apparent from FIGS. 19 and 20 that in a cross-section of the work 30, the length of the tapered portion 36 is greater than the total length of the bottom 34*b* and the punch-nose 38. Accordingly, in the press-working apparatus 300, it is possible to suppress thinning of the punch-nose 38, and mold the punch-nose 38 with an appropriate sheet thickness.

As a specific example, in the present embodiment, in the case where the wall 32 and the bottom 34 of the work 30 have a sheet thickness of 2 mm, deep drawing can be performed using the press-working apparatus 300 in a manner that the sheet thickness of the punch-nose 38 is maintained at 2 mm. Note that in the same case, in deep drawing according to a conventional technology, the sheet thickness of a punch-nose decreased to 1.57 mm.

In the second embodiment of the present invention described above, in deep drawing of the work 30 using the press-working apparatus 300, the fixed punch 344 is pushed into the recessed portion 126 later than the movable punch 346, and thus the tapered portion 36 is formed between the wall 32 and the bottom 34*a*. By molding the punch-nose 38 by expanding the tapered portion 36, thinning of the punch-nose 38 can be suppressed, as in the first embodiment. Also in the present embodiment, the press-working apparatus 300 may be uniaxial as in the first embodiment.

Also in the present embodiment, press working in the press-working apparatus 300 is not necessarily started from a state where the work 30 has a flat plate shape as illustrated in FIG. 18, and for example, primary molding of the work 30 may be performed in another apparatus, as in the first embodiment. In this case, as secondary molding, press working is started from a state where the U-shaped portion in the cross-section of the work 30 is received in the recessed portion 126 as illustrated in FIG. 19, in the press-working apparatus 300. In such a case, the press-working apparatus 300 need not be provided with the movable die 124 and the blank holder 360.

Note that in the first embodiment, the first punch that sandwiches the central area of the bottom and the second punch that molds the peripheral area of the bottom and the punch-nose while restraining the wall are both provided as a movable punch, but in the present embodiment, the second punch is a fixed punch. In addition, in the present embodiment, the third punch that abuts against the end surface of the wall is not provided, unlike in the first embodiment. Also in the first embodiment, it is possible to similarly adopt a configuration in which the third punch is not provided and the second punch is a fixed punch.

In addition, described in the present embodiment is suppression of thinning of a punch-nose in deep drawing, but similar thinning of a punch-nose may occur also in bending for obtaining a long molded product. Accordingly, also in bending, the configuration of the present embodiment may be adopted to suppress thinning of a punch-nose (i.e., the punch-nose is not necessarily thickened).

3. Third Embodiment: Thickening of Wall

Next, a third embodiment of the present invention is described. In the present embodiment, an additional molding step is added in which a molded product molded by a method in the first embodiment or the second embodiment (hereinafter also simply referred to as the "above embodiment") is further subjected to press working, and thus a molded product in which a wall is thicker than a bottom is molded. By press-molding a molded product with a thickened wall using a molded product molded by the above embodiment, the wall can be thickened without overlap of inner corner surfaces. Hereinafter, assuming the use of a molded product molded by the above embodiment, description will be given on the additional molding step of thickening the wall.

Figure 21:
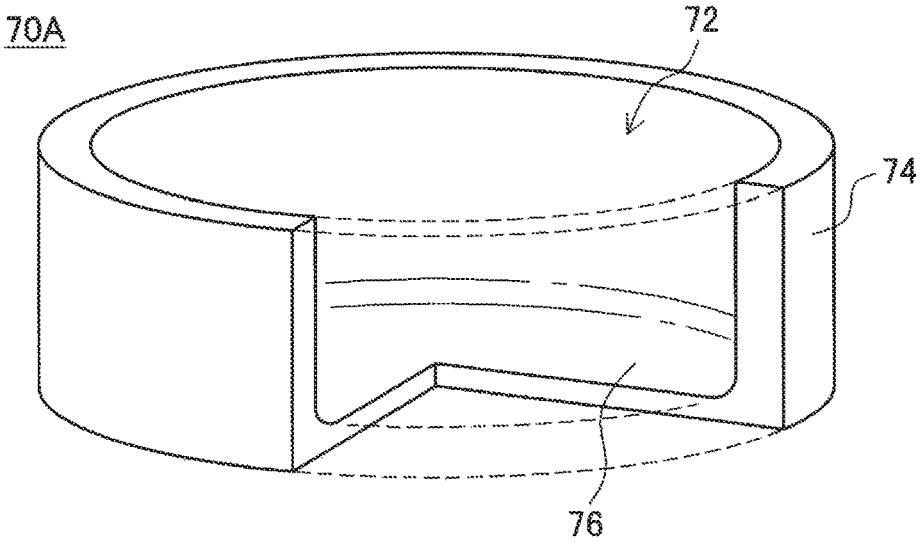
FIG. 21 is an explanatory diagram illustrating an example of a molded product molded by press working according to a third embodiment of the present invention.

FIG. 21 is an explanatory diagram illustrating an example of a molded product 70A molded by press working according to the present embodiment. The molded product 70A illustrated in FIG. 21 is a cup-shaped molded product that includes a wall 74 and a bottom 76, and has a recessed portion 72 formed from the wall 74 and the bottom 76. For example, this molded product 70A is molded by further performing press working using a second press-working apparatus described below, on the cup-shaped molded product 60 including, in a cross-section, a U-shaped portion in which the outside of the punch-nose has a small curvature radius or is substantially right-angled, which is illustrated in FIG. 9B.

Figure 22:
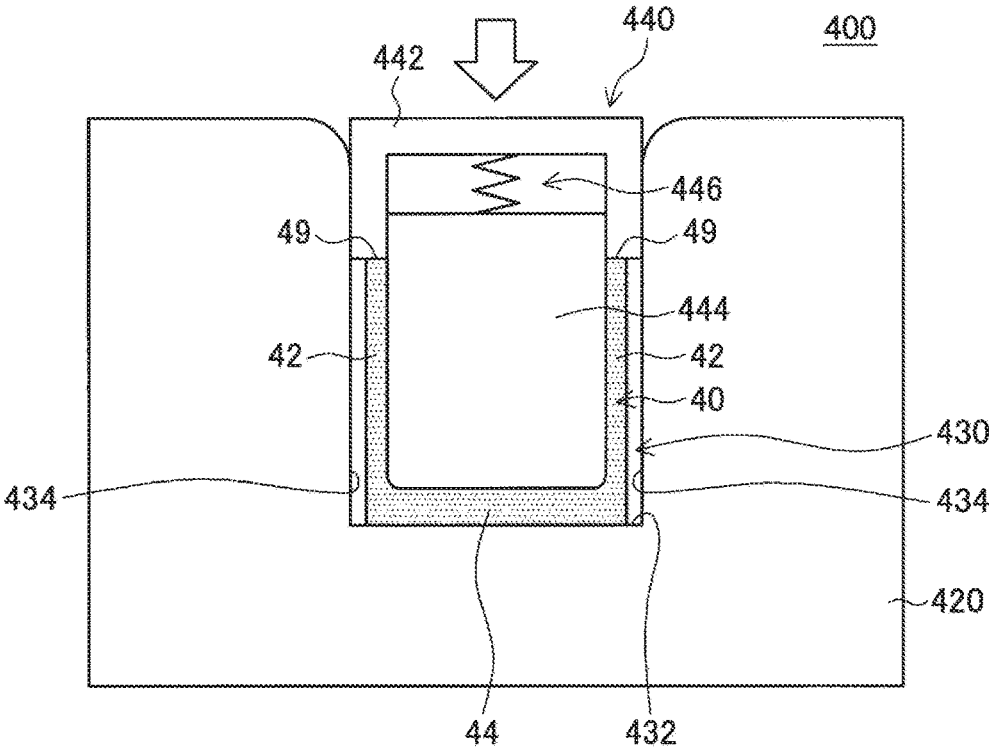
FIG. 22 is a schematic cross-sectional diagram illustrating an initial state of press working to thicken a wall.
Figure 23:
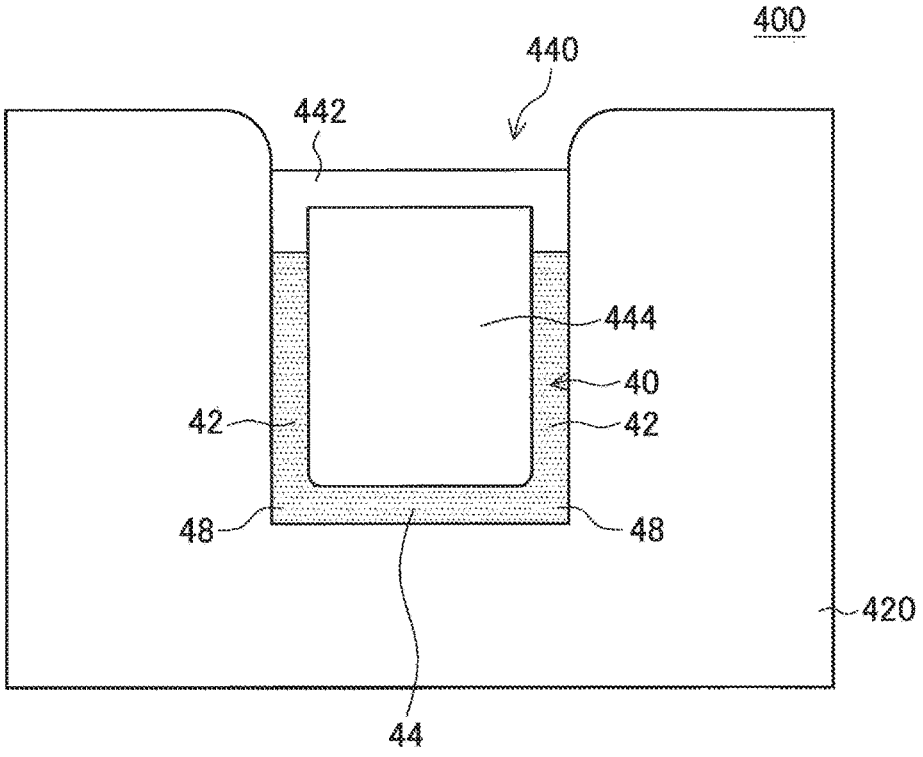
FIG. 23 is a schematic cross-sectional diagram illustrating a state of press working to thicken a wall, after thickening of the wall.

FIGS. 22 and 23 illustrate a configuration of a press-working apparatus 400 for thickening the wall 74, which is the second press-working apparatus according to the present embodiment. FIG. 22 is a schematic cross-sectional diagram illustrating an initial state of press working to thicken a wall. FIG. 23 is a schematic cross-sectional diagram illustrating a state after thickening of the wall. According to FIGS. 22 and 23, the press-working apparatus 400 includes a die 420 and a punch 440. The die 420 is a fixed die. The punch 440 includes a fixed punch 442 and a movable punch (pad) 444.

As illustrated in FIG. 22, at the time of starting press working in the present embodiment, a work 40 is a molded product molded by any of the above embodiments, in which the outside of the punch-nose has a small curvature radius or is substantially right-angled. For example, the work 40 is the cup-shaped molded product 60 illustrated in FIG. 9B, and in this case, the cup-shaped molded product 70A in which the wall 74 is thickened, which is illustrated in FIG. 21, is molded by the press-working apparatus 400. Note that the present invention is not limited to this example, and it is also possible to obtain a long molded product having a channel shape with a thickened wall from the long molded product 50 having a channel shape illustrated in FIG. 9A, for example, by the press-working apparatus 400.

The die 420 has a recessed portion 430 that accommodates the work 40. The shape of the recessed portion 430 is formed to correspond to the shape of a molded product to be produced using the work 40. Consequently, a length of the recessed portion 430 in an opposing direction of a wall 42 of the work 40 is greater than a length between opposing outer surfaces of the wall 42. The work 40 is placed in the recessed portion 430 with an opening side of the cup shape facing the punch 440 side, in a manner that a space corresponding to thickening to be caused by the press working is present on the outside of the wall 42 of the work 40, in a state where the work 40 is accommodated in the recessed portion 430.

On the other hand, the movable punch 444 of the punch 440 has a shape corresponding to the cup shape of the work 40. The movable punch 444 is inserted from the opening of the work 40, and is placed in a manner that its lower surface and side surface are in contact with the inner surface (i.e., a bottom surface 432 and a side surface 434) of the cup shape of the work 40. At this time, the movable punch 444 presses the work 40 by a cushion 446 linked to the fixed punch 442, and sandwiches a bottom 44 of the work 40 with the bottom surface 432 of the recessed portion 430 of the die 420. In addition, the fixed punch 442 abuts against an end surface 49 of the wall 42 of the work 40.

When press working by the press-working apparatus 400 is started, the cushion 446 provided between the fixed punch 442 and the movable punch 444 shrinks, and the fixed punch 442 moves toward the bottom surface 432 of the recessed portion 430, as illustrated in FIG. 23. Thus, a material constituting the wall 42 of the work 40 flows to the space present between the wall 42 and the recessed portion 430 of the die 420, to fill the space. In this manner, as illustrated in FIG. 23, it is possible to thicken the wall 42 of the work 40 as compared with before press working, and make the outside of a punch-nose 48 after press working have a small curvature radius or be substantially right-angled like before press working.

Here, a molded product molded according to the present embodiment is obtained by performing press working using the press-working apparatus 400 on a molded product in which the outside of a punch-nose has a small curvature radius or is substantially right-angled, which is molded according to the above embodiment. If the outside of a punch-nose of a work has a large curvature radius and the punch-nose has a small sheet thickness, when the press-working apparatus 400 presses an end of a wall, a material of the wall and a bottom flows, and flaws such as a fold mark occur on the inside of the punch-nose. The fold mark portion is a portion where inner surfaces of the wall and the bottom contact and overlap each other, and the wall and the bottom are likely to be released from the overlap to open; thus, strength decreases as compared with other portions. In addition, the fold mark portion may cause fatigue breakdown.

In contrast, in the case where a molded product including, in a cross-section, a U-shaped portion in which the outside of the punch-nose has a small curvature radius or is substantially right-angled is used as a work as in the present embodiment, a material of the punch-nose 48 flows in a state where the bottom 44 of the work 40 is sandwiched by the bottom surface 432 of the recessed portion 430 and a lower surface of the movable punch 444, and a space between the punch-nose 48 and the bottom surface 432 and the side surface 434 of the recessed portion 430 is filled. Consequently, it is possible to make the outside of the punch-nose 48 have a small curvature radius or be substantially right-angled like before press working, without causing a fold mark on the inside of the punch-nose 48.

In the third embodiment of the present invention described above, in press-working of the work 40 using the press-working apparatus 400, a molded product including, in a cross-section, a U-shaped portion in which the outside of the punch-nose has a small curvature radius or is substantially right-angled, which is molded in the above embodiment, is used as the work 40. Then, the press-working apparatus 400 applies a load to the end surface 49 of the wall 42 in a state where the bottom 44 of the work 40 is sandwiched; thus, the wall 42 can be thickened without causing a material to flow between the wall 42 and the bottom 44. In addition, it is possible to make the outside of the punch-nose 48 have a small curvature radius as compared with a conventional technology or make the outside of the punch-nose 48 substantially right-angled; thus, the punch-nose 48 after molding can also be thickened.

4. Fourth Embodiment: Extrusion of Wall

Next, a fourth embodiment of the present invention is described. In the present embodiment, an additional molding step is added in which a molded product molded by a method in the first embodiment or the second embodiment is further subjected to press working, and thus a molded product in which a wall is extended with respect to a bottom is molded. By press-molding a molded product in which a wall is extended with respect to a bottom using a molded product molded by the above embodiment, the wall can be extruded without overlap of inner corner surfaces, and the wall can be extended. Hereinafter, assuming the use of a molded product molded by the above embodiment, description will be given on the additional molding step of extending the wall.

Figure 24:
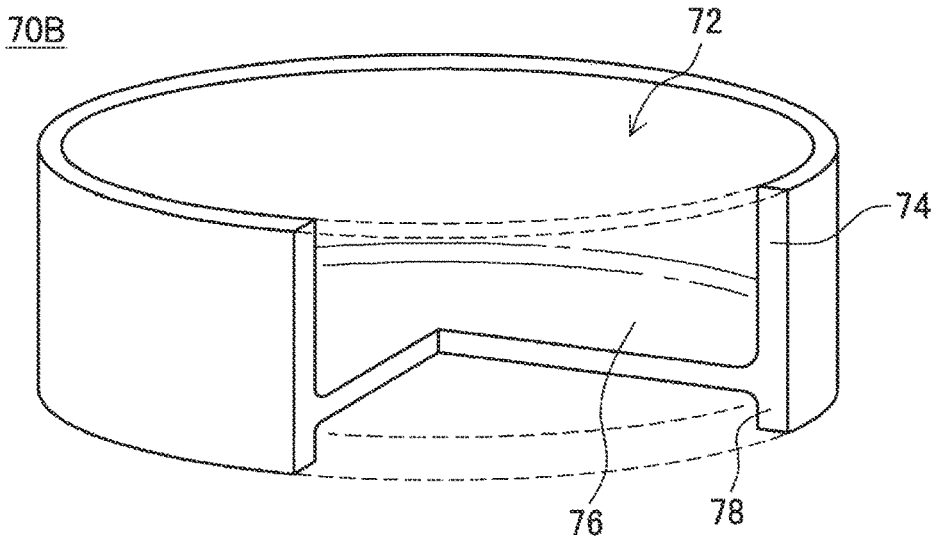
FIG. 24 is an explanatory diagram illustrating an example of a molded product molded by press working according to a fourth embodiment of the present invention.

FIG. 24 is an explanatory diagram illustrating an example of a molded product 70B molded by press working according to the present embodiment. The molded product 70B illustrated in FIG. 24 is a cup-shaped molded product that includes the wall 74, the bottom 76, and a vertical wall extended portion 78, and has the recessed portion 72 formed from the wall 74 and the bottom 76. For example, this molded product 70B is also molded by further performing press working using a second press-working apparatus described below, on the cup-shaped molded product 60 including, in a cross-section, a U-shaped portion in which the outside of the punch-nose has a small curvature radius or is substantially right-angled, which is illustrated in FIG. 9B.

Figure 25:
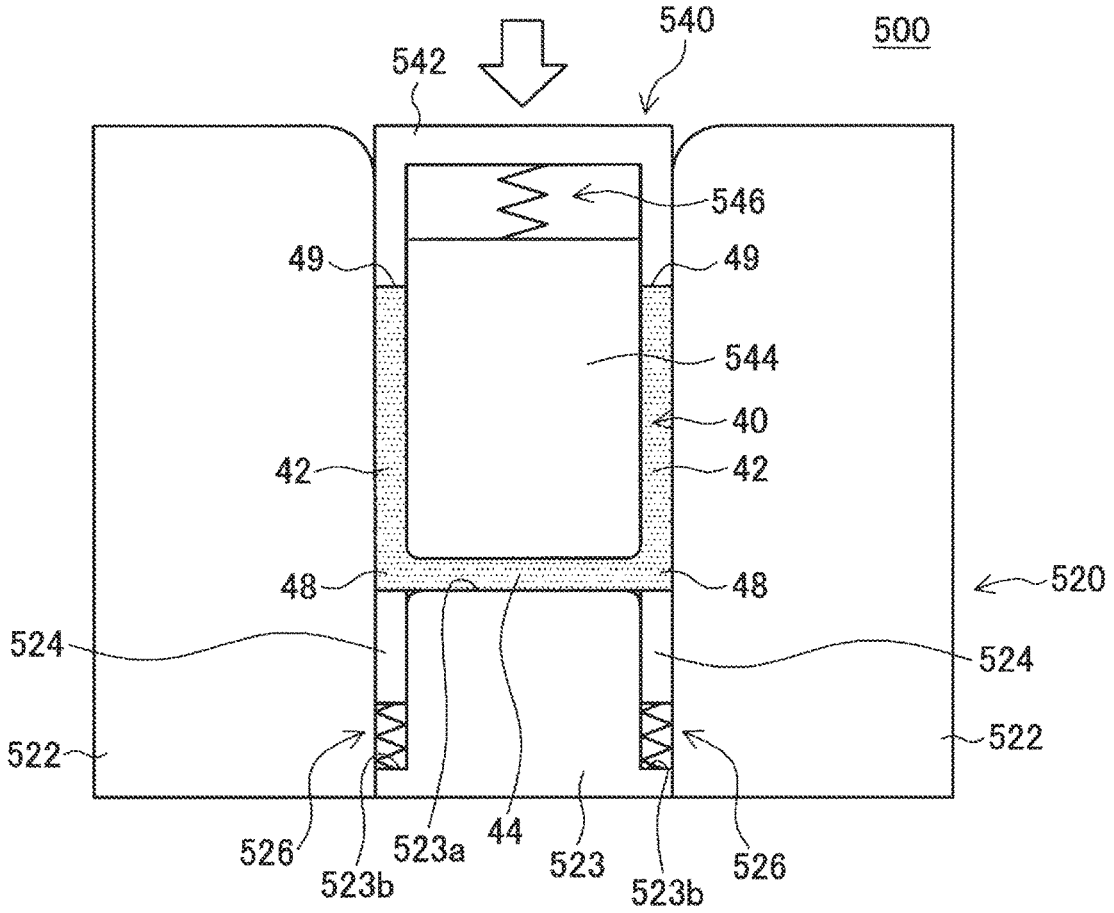
FIG. 25 is a schematic cross-sectional diagram illustrating an initial state of press working to extend a wall.
Figure 26:
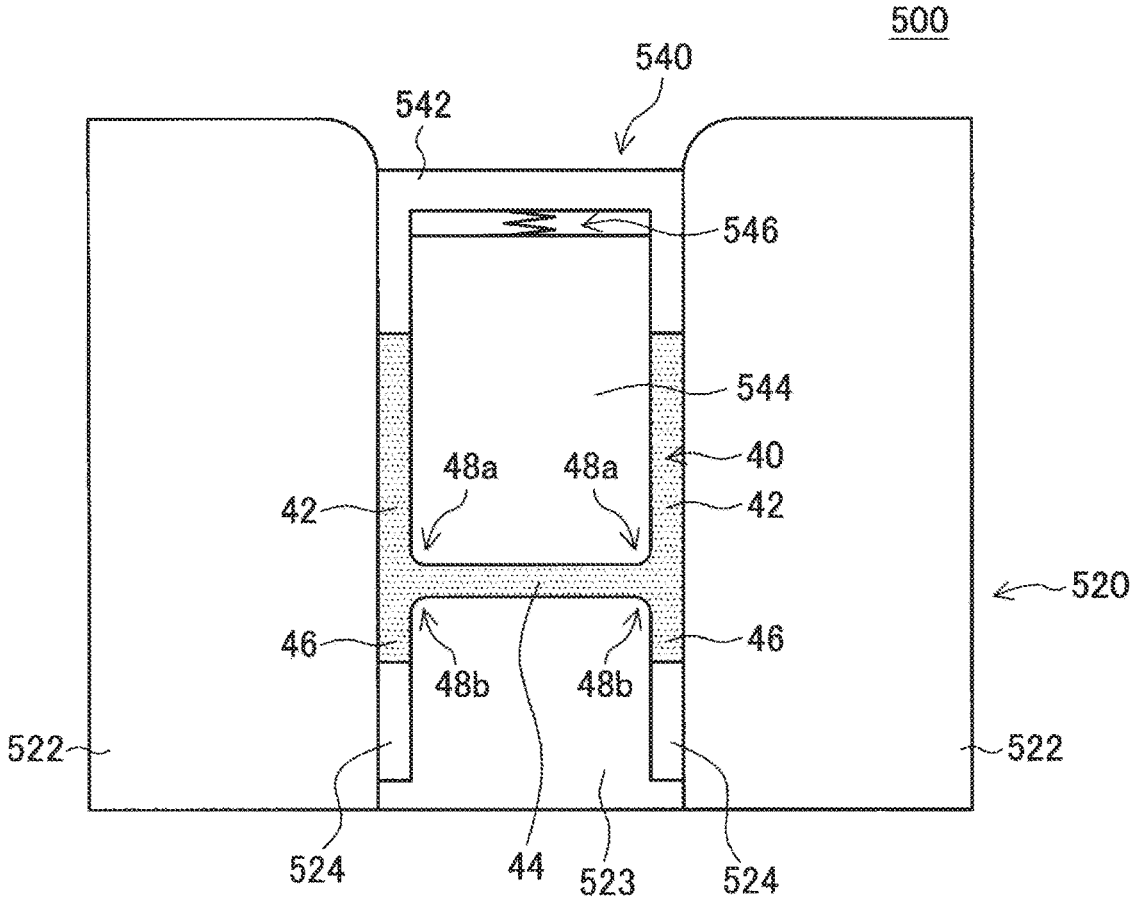
FIG. 26 is a schematic cross-sectional diagram illustrating a state after extension of the wall.

FIGS. 25 and 26 illustrate a configuration of a press-working apparatus 500 for extending the wall 74, which is the second press-working apparatus according to the present embodiment. FIG. 25 is a schematic cross-sectional diagram illustrating an initial state of press working to extend a wall. FIG. 26 is a schematic cross-sectional diagram illustrating a state after extension of the wall. According to FIGS. 25 and 26, the press-working apparatus 500 includes a die 520 and a punch 540. The die 520 includes a vertical wall fixed die 522, a ceiling fixed die 523, and a movable die (pad) 524. The punch 540 includes a fixed punch 542 and a movable punch (pad) 544.

As illustrated in FIG. 25, at the time of starting press working in the present embodiment, the work 40 is a molded product molded by a method in the first embodiment or the second embodiment as in the third embodiment, in which the outside of the punch-nose has a small curvature radius or is substantially right-angled. For example, the work 40 is the cup-shaped molded product 60 illustrated in FIG. 9B, and in this case, the cup-shaped molded product 70B in which the wall 74 is extended, which is illustrated in FIG. 24, is molded by the press-working apparatus 500. Note that the present invention is not limited to this example, and it is also possible to obtain a long molded product having a channel shape with an extended wall from the long molded product 50 having a channel shape illustrated in FIG. 9A, for example, by the press-working apparatus 500.

In the die 520, the vertical wall fixed die 522, the ceiling fixed die 523, and the movable die 524 form a recessed portion that accommodates the work 40. The vertical wall fixed die 522 supports the wall 42 of the work 40, and the ceiling fixed die 523 and the movable die 524 support the bottom 44 of the work 40. As illustrated in FIG. 24, the inner surface of the ceiling fixed die 523 includes a central area (an area excluding a portion where the wall 42 is to be extended on each side) 523*a* that is able to contact the bottom 44 of the work 40, and an end area 523*b* that is depressed relative to the central area 523*a* to the opposite side to the punch 540. When the vertical wall fixed die 522 is placed on each side of the ceiling fixed die 523, a space is formed at the end area 523*b*. The movable die 524 is placed in this space in a state of being supported by a cushion 526 linked to the end area 523*b* of the ceiling fixed die 523. When the work 40 is placed in the recessed portion of the die 520, the movable die 524 is pushed in, by the bottom 44 of the work 40, to a position such that the bottom 44 abuts against the central area 523*a* of the inner surface of the ceiling fixed die 523.

On the other hand, the movable punch 544 of the punch 540 has a shape corresponding to the cup shape of the work 40. The movable punch 544 is inserted from the opening of the work 40, and is placed in a manner that its lower surface and side surface are in contact with the inner surface (i.e., a bottom surface and a side surface) of the cup shape of the work 40. At this time, the movable punch 544 that is linked to the fixed punch 542 by a cushion 546 presses the work 40, and sandwiches the bottom 44 of the work 40 with the ceiling fixed die 523. In addition, the fixed punch 542 abuts against the end surface 49 of the wall 42 of the work 40. In the initial state, the work 40 is not deformed by the fixed punch 542 abutting against the end surface 49 of the wall 42 of the work 40.

When press working by the press-working apparatus 500 is started, the cushion 546 provided between the fixed punch 542 and the movable punch 544 shrinks, and the fixed punch 542 moves toward the bottom surface of the recessed portion, as illustrated in FIG. 26. Thus, while pushing in the movable die 524 and causing the cushion 526 to shrink, a material constituting the wall 42 of the work 40 moves to fill a space between the vertical wall fixed die 522 and the central area of the ceiling fixed die 523, in place of the movable die 524. In this manner, as illustrated in FIG. 26, it is possible to extend the wall 42 of the work 40 as compared with before press working.

At this time, the work 40 after press working has a first inner punch-nose 48*a* inside the recessed portion, and a second inner punch-nose 48*b* formed by the vertical wall extended portion 46 obtained by extending the wall 42 and the bottom 44. As in the third embodiment, a molded product molded according to the present embodiment is obtained by performing press working using the press-working apparatus 500 on a molded product in which the outside of a punch-nose has a small curvature radius or is substantially right-angled, which is molded according to the first embodiment or the second embodiment. If the outside of a punch-nose of a work has a large curvature radius and the punch-nose has a small sheet thickness, when the press-working apparatus 500 presses an end of a wall, a material of the wall and a bottom flows, and flaws such as a fold mark occur in the first inner punch-nose 48*a*. The fold mark portion has lower strength than other portions, and may cause fatigue breakdown.

In contrast, in the case where a molded product including, in a cross-section, a U-shaped portion in which the outside of the punch-nose has a small curvature radius or is substantially right-angled is used as a work as in the present embodiment, a material of the punch-nose 48 flows while pushing down the movable die 524, in a state where the bottom 44 of the work 40 is sandwiched by the bottom surface of the recessed portion and a lower surface of the movable punch 544. Consequently, a fold mark does not occur on the inside of the punch-nose 48. In addition, in the second inner punch-nose 48*b*, as in the first inner punch-nose 48*a*, it is desirable to provide the inside of the punch-nose 48 with some curvature radius (not close to zero) in terms of avoiding stress concentration on the punch-nose 48. For example, the second inner punch-nose 48*b* may be provided with substantially the same curvature radius as the first inner punch-nose 48*a*.

In the fourth embodiment of the present invention described above, in press-working of the work 40 using the press-working apparatus 500, a molded product including, in a cross-section, a U-shaped portion in which the outside of the punch-nose has a small curvature radius or is substantially right-angled, which is molded in the above embodiment, is used as the work 40. Then, the press-working apparatus 500 applies a load to the end surface 49 of the wall 42 in a state where the central area 523*a* of the bottom 44 of the work 40 is sandwiched. Thus, the wall 42 can be extended without causing a material to flow between the wall 42 and the bottom 44, and a fold mark does not occur in the first inner punch-nose 48*a*.

5. Fifth Embodiment: Extrusion of Bottom

Next, a fifth embodiment of the present invention is described. In the present embodiment, an additional molding step is added in which a molded product molded by a method in the first embodiment or the second embodiment is further subjected to press working, and thus a molded product with an extended bottom is molded. By press-molding a molded product with an extended bottom using a molded product molded by the above embodiment, the bottom can be extruded without overlap of inner corner surfaces, and the bottom can be extended. Hereinafter, assuming the use of a molded product molded by the above embodiment, description will be given on the additional molding step of extending the bottom.

Figure 27:
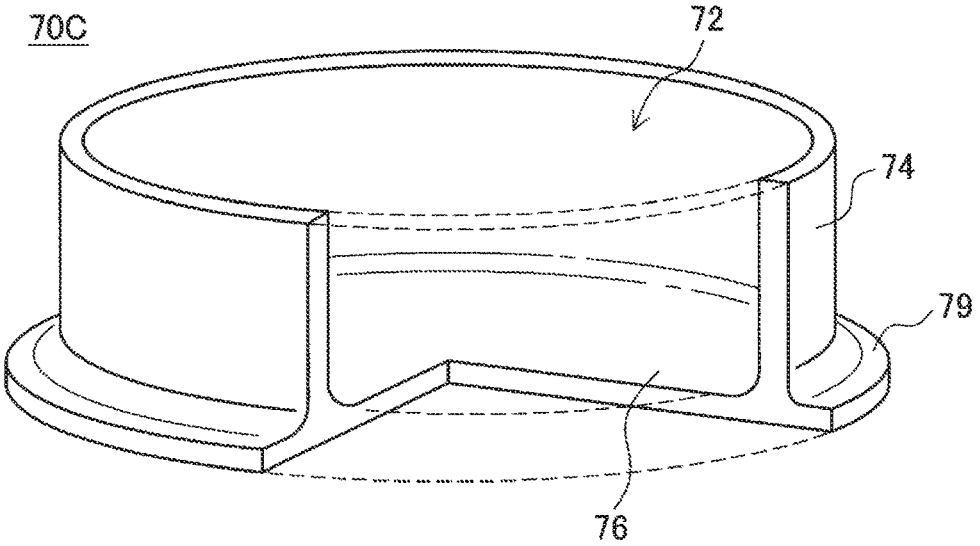
FIG. 27 is an explanatory diagram illustrating an example of a molded product molded by press working according to a fifth embodiment of the present invention.

FIG. 27 is an explanatory diagram illustrating an example of a molded product 70C molded by press working according to the present embodiment. The molded product 70C illustrated in FIG. 27 is a cup-shaped molded product that includes the wall 74, the bottom 76, and a ceiling extended portion 79, and has the recessed portion 72 formed from the wall 74 and the bottom 76. For example, this molded product 70C is also molded by further performing press working using a second press-working apparatus described below, on the cup-shaped molded product 60 including, in a cross-section, a U-shaped portion in which the outside of the punch-nose has a small curvature radius or is substantially right-angled, which is illustrated in FIG. 9B.

Figure 28:
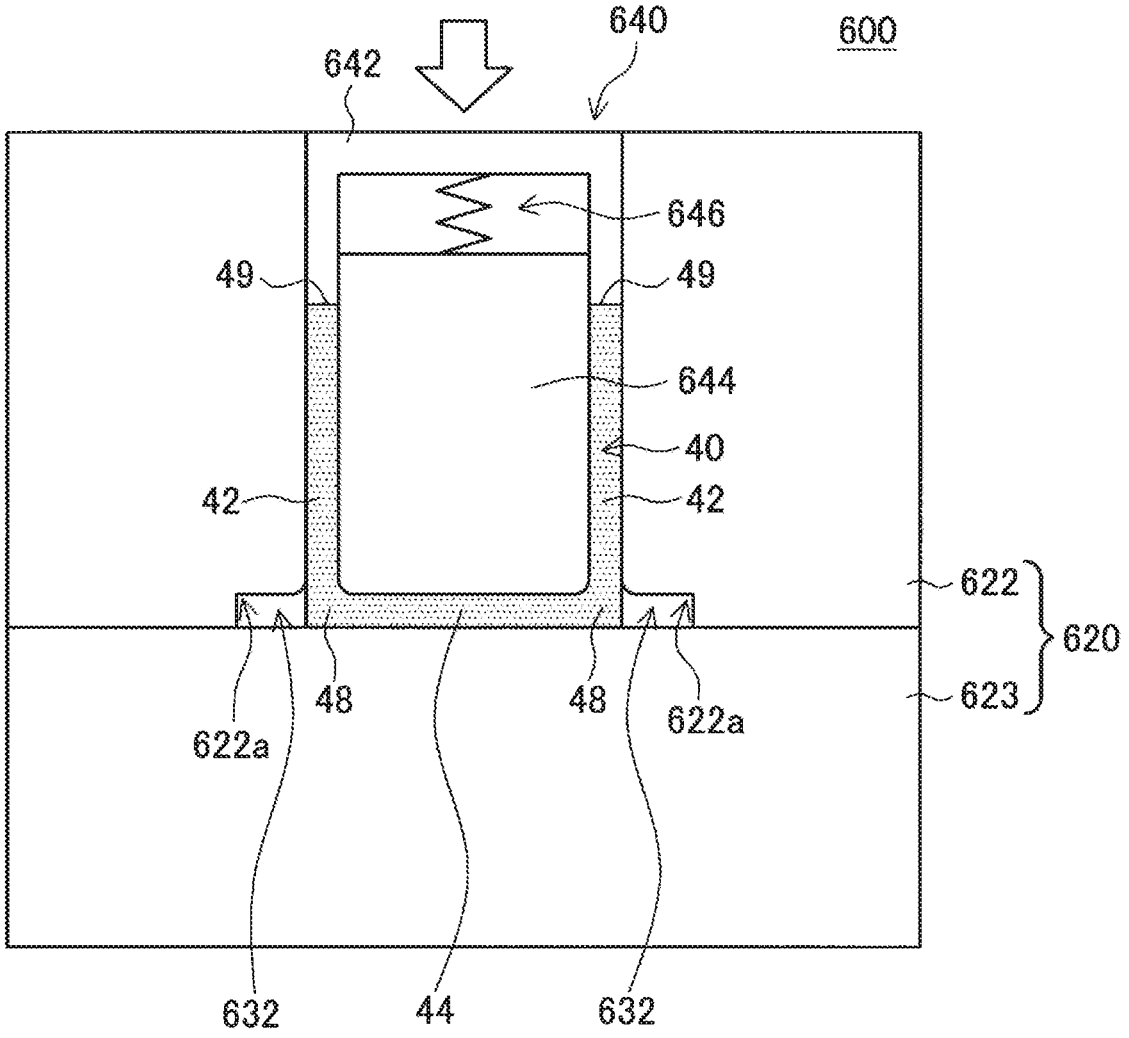
FIG. 28 is a schematic cross-sectional diagram illustrating an initial state of press working to extend a bottom.
Figure 29:
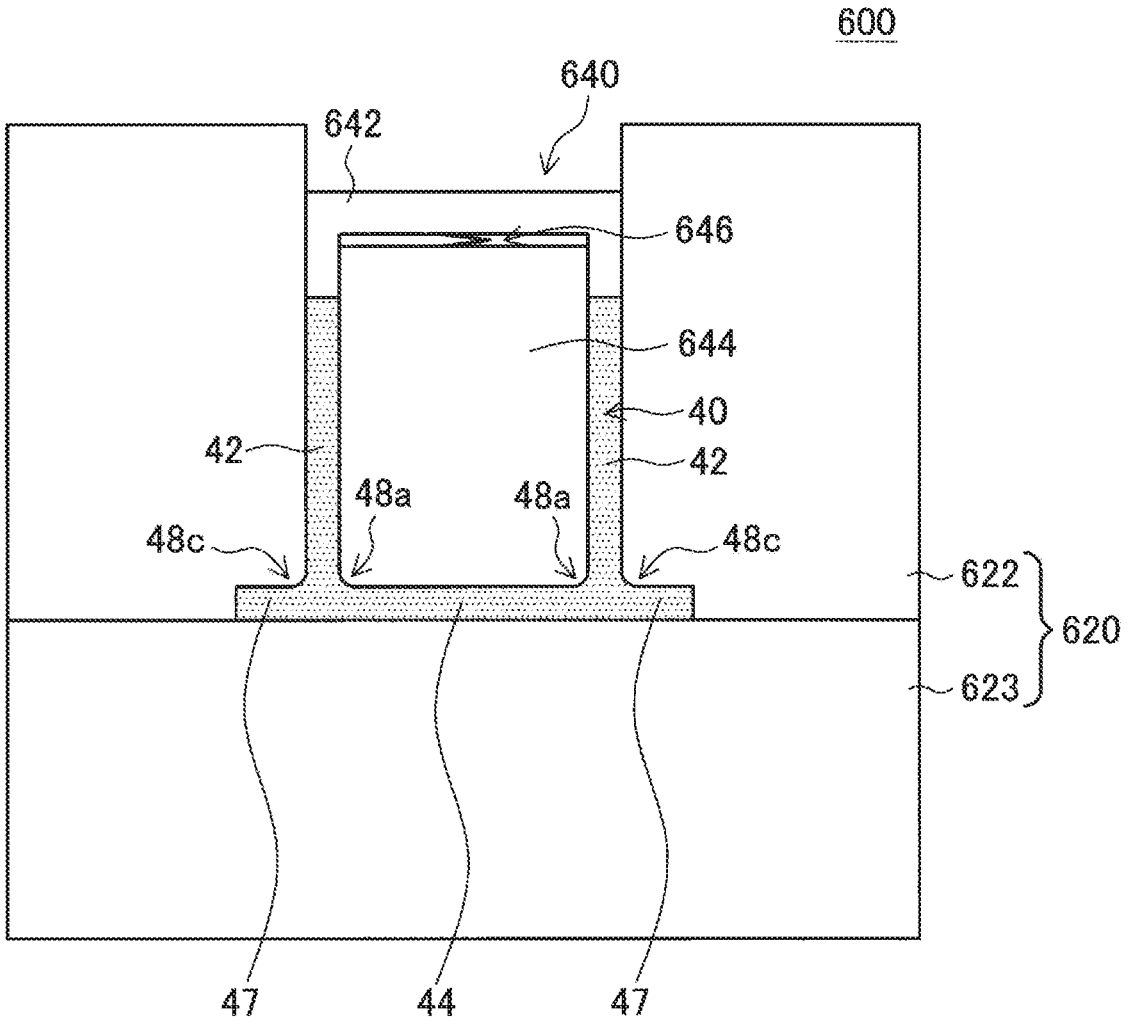
FIG. 29 is a schematic cross-sectional diagram illustrating a state after extension of the bottom.

FIGS. 28 and 29 illustrate a configuration of a press-working apparatus 600 for extending the bottom 76, which is the second press-working apparatus according to the present embodiment. FIG. 28 is a schematic cross-sectional diagram illustrating an initial state of press working to extend a bottom. FIG. 29 is a schematic cross-sectional diagram illustrating a state after extension of the bottom. According to FIGS. 28 and 29, the press-working apparatus 600 includes a die 620 and a punch 640. The die 620 includes a vertical wall fixed die 622 and a ceiling fixed die 623. The punch 640 includes a fixed punch 642 and a movable punch (pad) 644.

As illustrated in FIG. 28, at the time of starting press working in the present embodiment, the work 40 is a molded product molded by a method in the first embodiment or the second embodiment as in the third and fourth embodiments, in which the outside of the punch-nose has a small curvature radius or is substantially right-angled. For example, the work 40 is the cup-shaped molded product 60 illustrated in FIG. 9B, and in this case, the cup-shaped molded product 70C in which the bottom 76 is extended, which is illustrated in FIG. 27, is molded by the press-working apparatus 600. Note that the present invention is not limited to this example, and it is also possible to obtain a long molded product having a channel shape with an extended wall from the long molded product 50 having a channel shape illustrated in FIG. 9A, for example, by the press-working apparatus 600.

In the die 620, the vertical wall fixed die 622 and the ceiling fixed die 623 form a recessed portion that accommodates the work 40. The vertical wall fixed die 522 supports an area other than a portion where the bottom 44 is to be extended, of the wall 42 of the work 40. In addition, in a portion of the vertical wall fixed die 622 that corresponds to an area of the portion where the bottom 44 is to be extended, a step portion 622*a* depressed in a direction going away from the wall 42 of the work 40 is formed to correspond to the shape of a ceiling extended portion 47 to be formed. By installing the vertical wall fixed die 622 on the ceiling fixed die 623, a space 632 corresponding to the shape of the ceiling extended portion 47 is formed by the step portion 622*a* of the vertical wall fixed die 622 and the ceiling fixed die 623. The work 40 placed in the recessed portion of the die 620 is in a state where a partial area of the wall 42 and the bottom 44 are supported, as illustrated in FIG. 28.

On the other hand, the movable punch 644 of the punch 640 has a shape corresponding to the cup shape of the work 40. The movable punch 644 is inserted from the opening of the work 40, and is placed in a manner that its lower surface and side surface are in contact with the inner surface (i.e., a bottom surface and a side surface) of the cup shape of the work 40. At this time, the movable punch 644 presses the work 40 by a cushion 646 linked to the fixed punch 642, and sandwiches the bottom 44 of the work 40 with the ceiling fixed die 623. In addition, the fixed punch 642 abuts against the end surface 49 of the wall 42 of the work 40. In the initial state, the work 40 is not deformed by the fixed punch 642 abutting against the end surface 49 of the wall 42 of the work 40.

When press working by the press-working apparatus 600 is started, the cushion 646 provided between the fixed punch 642 and the movable punch 644 shrinks, and the fixed punch 642 moves toward the bottom surface of the recessed portion, as illustrated in FIG. 29. Thus, a material of the punch-nose 48 moves to fill the space 632 between the step portion 622*a* of the vertical wall fixed die 622 and the ceiling fixed die 623. In this manner, as illustrated in FIG. 29, it is possible to extend the bottom 44 of the work 40 as compared with before press working.

As in the third and fourth embodiments, a molded product molded according to the present embodiment is obtained by performing press working using the press-working apparatus 600 on a molded product in which the outside of a punch-nose has a small curvature radius or is substantially right-angled, which is molded according to the first embodiment or the second embodiment. If the outside of a punch-nose of a work has a large curvature radius and the punch-nose has a small sheet thickness, when the press-working apparatus 600 presses an end of a wall, a material of the wall and a bottom flows, and flaws such as a fold mark occur inside the punch-nose 48. The fold mark portion has lower strength than other portions, and may cause fatigue breakdown.

In contrast, in the case where a molded product including, in a cross-section, a U-shaped portion in which the outside of the punch-nose has a small curvature radius or is substantially right-angled is used as a work as in the present embodiment, a material of the punch-nose 48 flows in a state where the bottom 44 of the work 40 is sandwiched by the bottom surface of the recessed portion and a lower surface of the movable punch 644, and the space 632 is filled. Consequently, a fold mark does not occur in the first inner punch-nose 48*a* formed by the inner surface of the wall 42 and the bottom 44. Note that by the formation of the ceiling extended portion 47 obtained by extending the bottom 44, a third inner punch-nose 48*c* is formed by the outer surface of the wall 42 and the ceiling extended portion 47. In the third inner punch-nose 48*c*, as in the first inner punch-nose 48*a*, it is desirable to provide the inside of the punch-nose 48 with some curvature radius (not close to zero) in terms of avoiding stress concentration on the punch-nose 48. For example, the third inner punch-nose 48*c* may be provided with substantially the same curvature radius as the first inner punch-nose 48*a*.

In the fifth embodiment of the present invention described above, in press-working of the work 40 using the press-working apparatus 600, a molded product including, in a cross-section, a U-shaped portion in which the outside of the punch-nose has a small curvature radius or is substantially right-angled, which is molded in the above embodiment, is used as the work 40. Then, the press-working apparatus 600 applies a load to the end surface 49 of the wall 42 in a state where the bottom 44 of the work 40 is sandwiched. Thus, the bottom 44 can be extended without causing a material to flow between the wall 42 and the bottom 44, and a fold mark does not occur in the first inner punch-nose 48*a*.

6. Conclusion

According to the first and second embodiments of the present invention described above, in press working of a work using a press-working apparatus, a tapered portion is formed between a wall and a bottom, and then a punch-nose is molded by expanding the tapered portion. Thus, the punch-nose can be thickened without causing a material to flow between the wall and the bottom. Therefore, it is possible to make the outside of the punch-nose have a small curvature radius as compared with a conventional technology or make the outside of the punch-nose substantially right-angled. In addition, according to the first and second embodiments of the present invention, the outside of the punch-nose is not molded to have a small curvature radius or be substantially right-angled from a flat plate in one step, but the shape of the outside of the punch-nose is molded by stepwise push-in; thus, press molding can be performed with a smaller load than that in a conventional technology. Consequently, even press molding of a steel material with high strength can be performed without causing a crack or the like in molding. Note that materials that can be molded by a press-molding method according to the first and second embodiments of the present invention include aluminum and the like, in addition to steel.

Moreover, according to the third to fifth embodiments of the present invention, a molded product in which the outside of a punch-nose has a small curvature radius or is substantially right-angled, which is molded by a press-molding apparatus of the first embodiment or the second embodiment, is used as a second work, and press working is further performed to form a molded product with another shape. Since the molded product in which the outside of the punch-nose has a small curvature radius or is substantially right-angled is used as the second work, flaws such as a fold mark can be prevented from occurring on the inside of the punch-nose when thickening of the wall or extension of the wall or the bottom is performed by press working.

Furthermore, molded products molded by a press-molding apparatus of the third to fifth embodiments of the present invention have complicated shapes, and generally have been formed by connecting a plurality of parts by welding or the like. However, a molded product with a complicated shape can be produced as one part by combining press molding using a press-molding apparatus of the first embodiment or the second embodiment and press molding using a press-molding apparatus of the third to fifth embodiments. This can reduce the number of parts and reduce the weight of a part, and also can cut production cost.

EXAMPLES

A crash test was performed to evaluate shock absorption performance of a press-molded product molded by a press-working apparatus of the present invention. In the present example, a three-point bending test was performed on a press-molded product with a channel shape having a U-shaped portion, in which a flange portion extending from a wall was formed, and shock absorption performance was evaluated on the basis of absorption energy per unit volume. The test was performed on five press-molded products having different shapes of punch-noses. A 980 MPa-grade steel sheet was used as a work. The press-molded product to be tested was molded using a press-working apparatus obtained by configuring the press-working apparatus 100 described in the first embodiment in a manner that a flange portion can be molded in addition.

Figure 30:
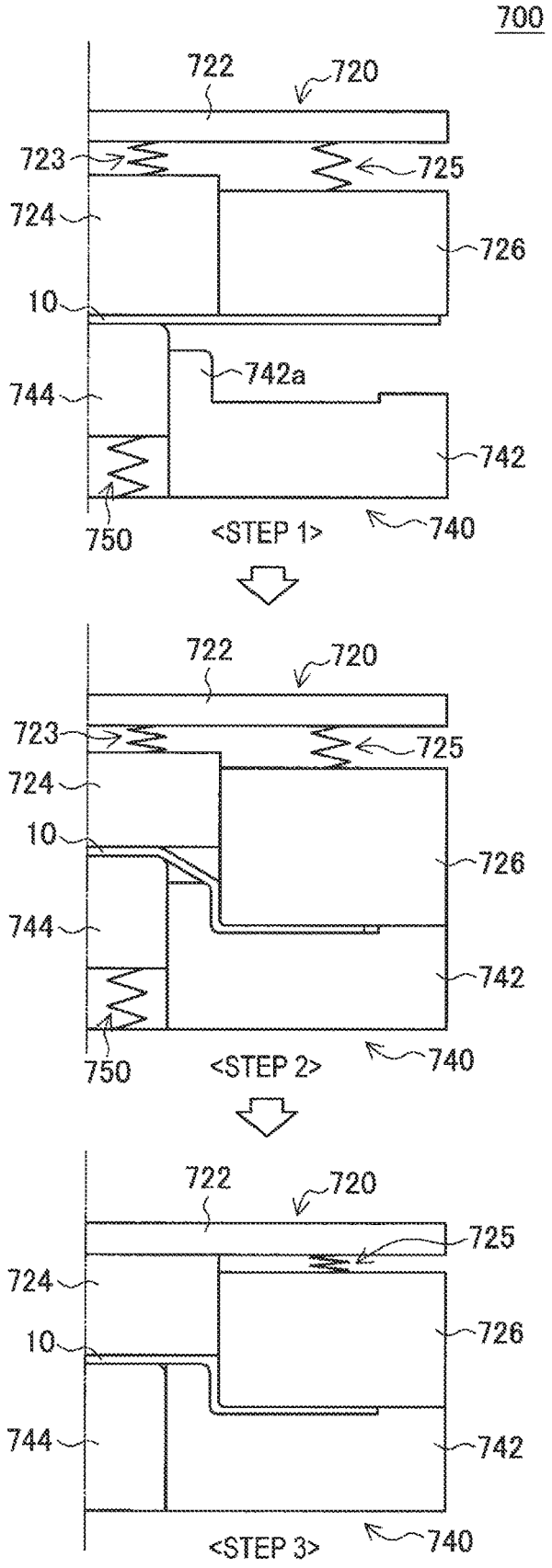
FIG. 30 is an explanatory diagram illustrating a method for molding a press-molded product having a channel shape with a flange to be tested in Examples.

Here, FIG. 30 illustrates a method for molding a press-molded product to mold a press-molded product with a flange portion to be tested. Note that FIG. 30 illustrates only the right half of a press-working apparatus 700, and actually, members in bilateral symmetry with respect to the center line are included. As illustrated in FIG. 30, the press-working apparatus 700 includes a die 720 and a punch 740. The die 720 includes a fixed portion 722, an inside movable die (pad) 724, and an outside movable die (pad) 726. The inside movable die 724 is supported by the fixed portion 722 by a cushion 723, and the outside movable die 726 is supported by the fixed portion 722 by a cushion 725. Meanwhile, the punch 740 includes a fixed punch 742 and a movable punch (pad) 744. The movable punch 744 is supported by the fixed punch 742 by a cushion 750.

First, in starting press working, the flat-plate-shaped work 10 is sandwiched by the movable punch 744 and the inside movable die 724 (STEP 1). Then, the die 720 is pushed in to the punch 740 side until the outside movable die 726 abuts against the fixed punch 742, a wall is restrained, between a projection 742*a* of the fixed punch 742 and the outside movable die 726, and a central area of a bottom is molded by the movable punch 744 and the inside movable die 724 (STEP 2). At this time, a tapered portion is formed between the central area of the bottom and the wall. In addition, a portion of the work 10 that is sandwiched by the outside movable die 726 and the fixed punch 742 becomes a flange portion.

After that, when the die 720 is further pushed in to the punch 740 side, the cushion 750 shrinks and the movable punch 744 abuts against the fixed punch 742. At this time, an end surface of the movable punch 744 is flush with an end surface of the projection 742*a* of the fixed punch 742. By bringing about this state, a peripheral area of the bottom and a punch-nose are molded. In this manner, the movable punch 744 is pushed in later than the fixed punch 742; thus, the punch-nose is thickened.

Figure 31:
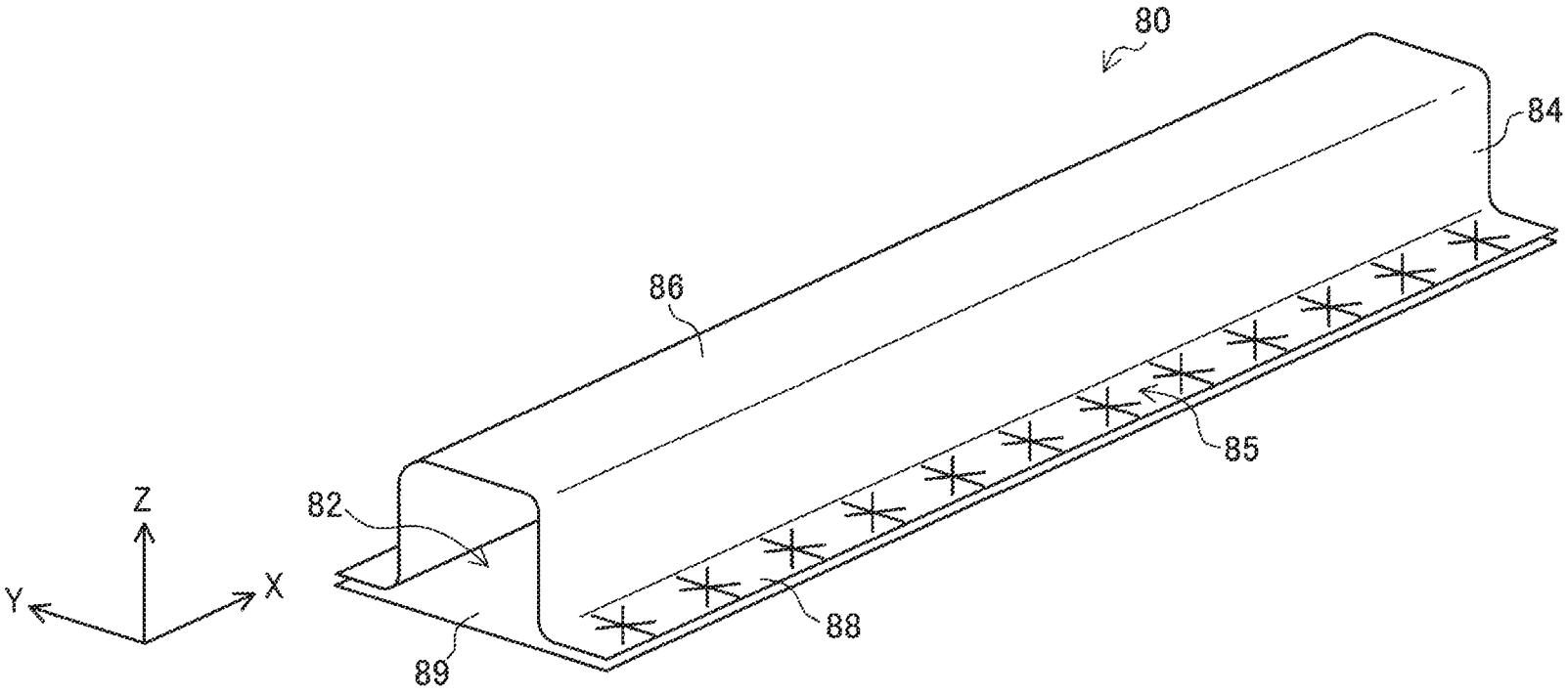
FIG. 31 is a perspective view of a press-molded product to be tested in Examples.
Figure 32:
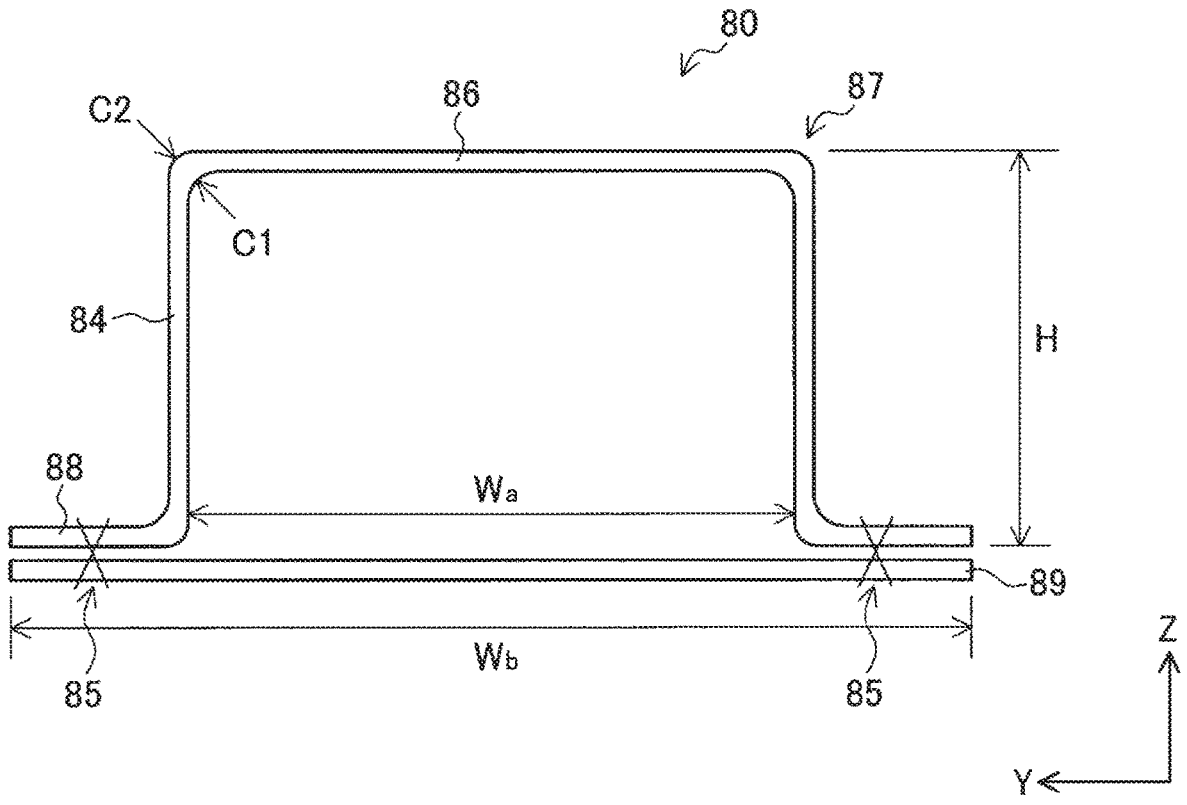
FIG. 32 is a front view of the press-molded product to be tested in Examples.

FIGS. 31 and 32 illustrate an outer shape of a press-molded product 80 molded by the press-working apparatus 700 illustrated in FIG. 30. FIG. 31 is a perspective view of the press-molded product 80, and FIG. 32 is a front view of the press-molded product 80. Note that for description, FIGS. 31 and 32 illustrate a state where a flange portion 88 and a flat plate 89 of the press-molded product 80 are away from each other, but actually they are in contact and welded. The press-molded product 80 is a long molded product including a channel shape 82. The press-molded product 80 includes a wall 84, a bottom 86, and the flange portion 88. In performing the shock absorption test, the flat plate 89 was placed to block an opening of the channel shape 82 of the press-molded product 80, and the flat plate 89 was spot-welded at the flange portion 88.

Figure 33:
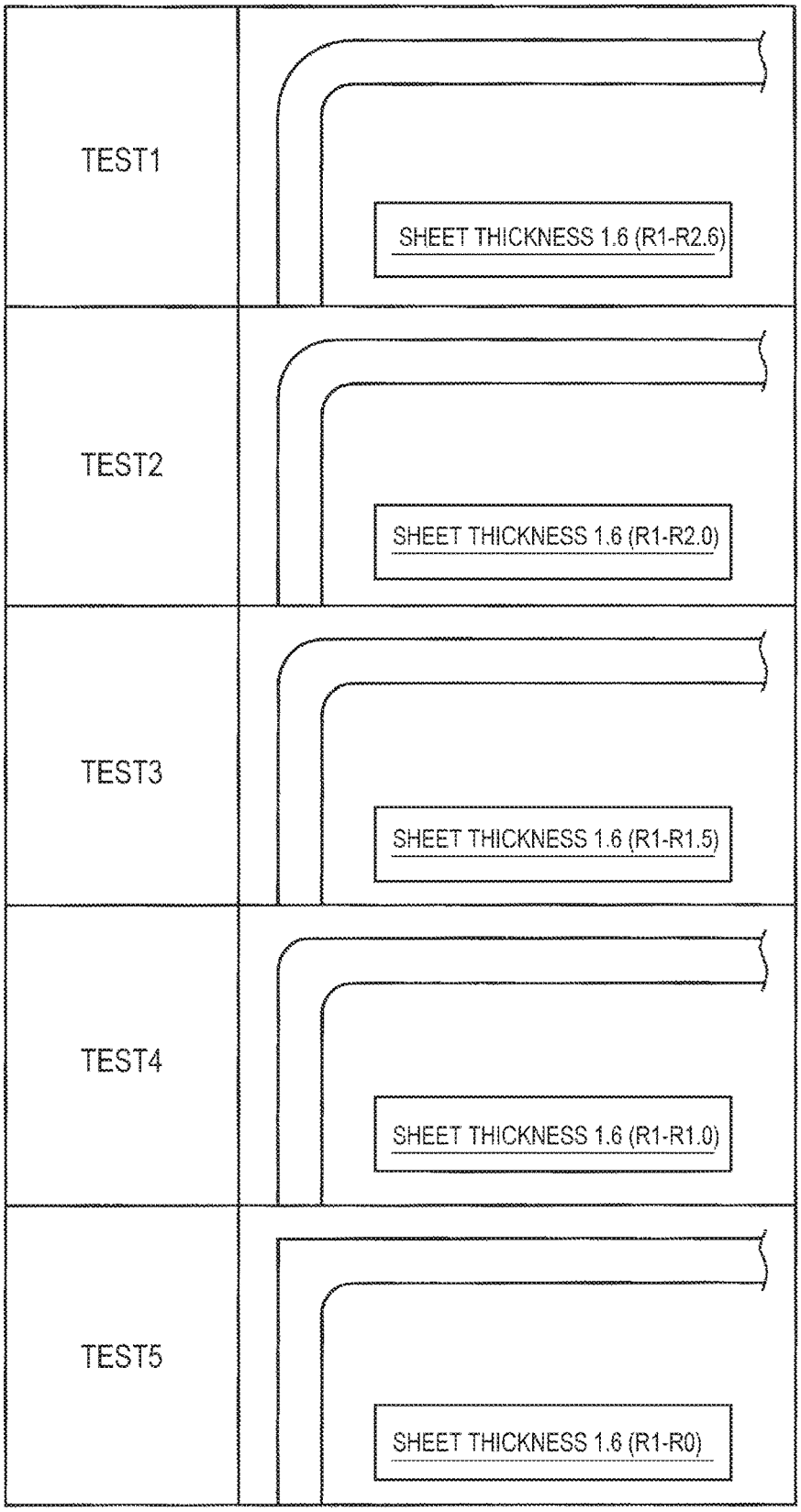
FIG. 33 is an explanatory diagram illustrating shapes of press-molded products to be tested in Examples.

In the present example, the press-molded product 80 with the shape illustrated in FIGS. 31 and 32 was molded with a height H set to 50 mm, an opening width Wa of the channel shape 82 set to 80 mm, and a width Wb of the press-molded product including the flange portions 88 set to 120 mm. The work had a sheet thickness of 1.6 mm. As shown in FIG. 33 and Table 1 below, press-molded products to be tested were molded with a curvature radius R1 of an inside C1 of a punch-nose 87 set in common to 1.0 mm and a curvature radius R2 of an outside C2 of the punch-nose 87 changed. Table 1 shows rates of thickening with reference to the press-molded product of Test 1 in which a sheet thickness of the punch-nose 87 is similar to a sheet thickness of the work. In addition, a length L of the press-molded product 80 in the longitudinal direction (X direction) was 300 mm.

TABLE 1

| No. | R1 [mm] | R2 [mm] | Sheet thickness of punch-nose [mm] | Rate of thickening |
|---|---|---|---|---|
| Test 1 | 1.0 | 2.6 | 1.60 | — |
| Test 2 | 1.0 | 2.0 | 1.85 | 16% |
| Test 3 | 1.0 | 1.5 | 2.06 | 29% |
| Test 4 | 1.0 | 1.0 | 2.26 | 41% |
| Test 5 | 1.0 | 0 | 2.64 | 65% |

Figure 34:
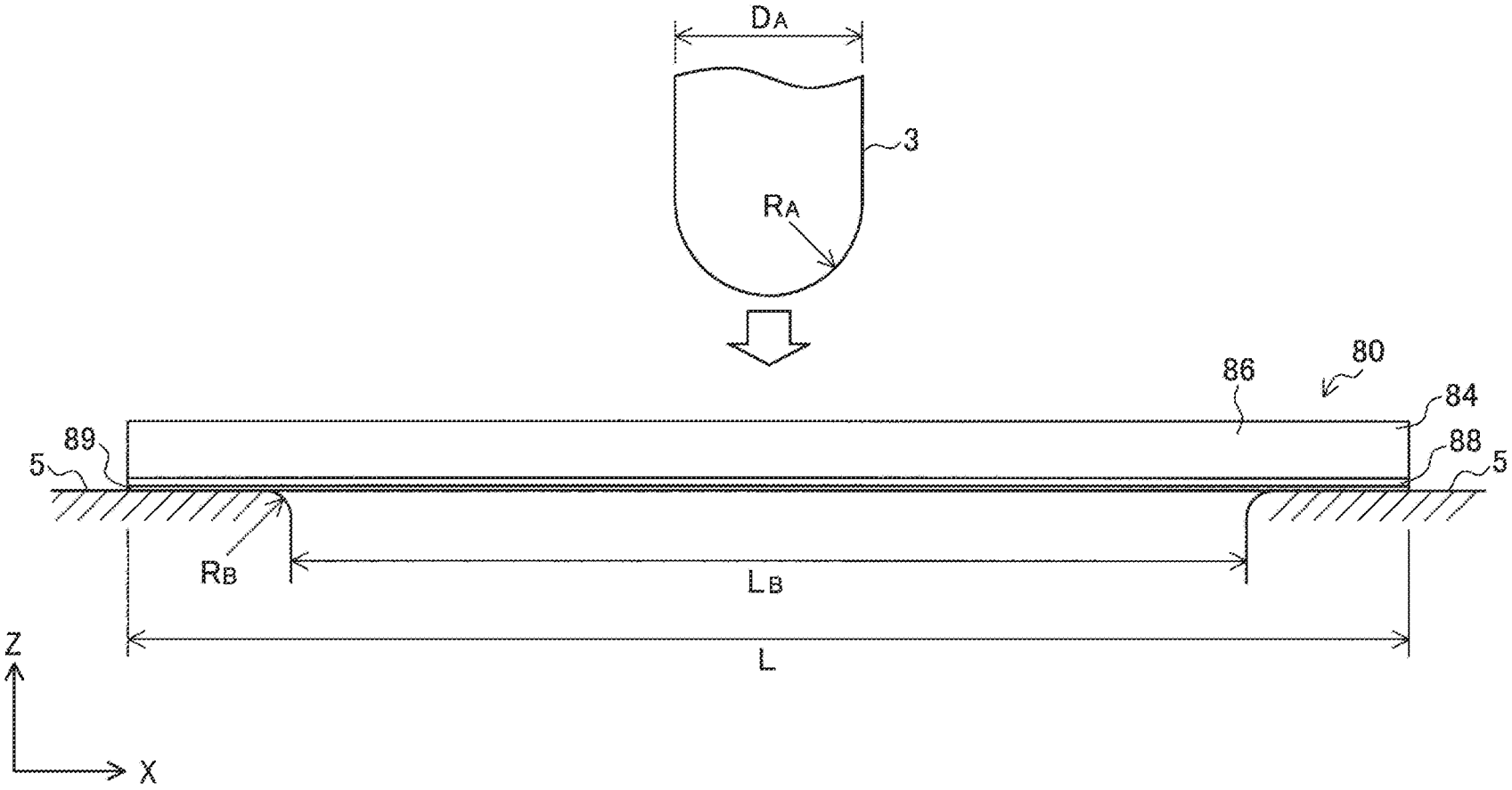
FIG. 34 is an explanatory diagram for describing a three-point bending test.

As illustrated in FIG. 34, the three-point bending test was performed with the press-molded product 80 to which the flat plate 89 was welded, which is illustrated in FIG. 31, installed in a manner that ends in the longitudinal direction are supported by support portions 5 of a tester. A distance $L_B$ between the support portions 5 was 200 mm. A curvature radius $R_B$ of a punch-nose of the support portion 5 was 15 mm. Then, at the center between the support portions 5, the bottom 86 of the press-molded product 80 was pressed by an indenter 3. The indenter 3 is a circular cylindrical member whose tip is formed with a curved surface, and had a weight of 300 kg, a diameter $D_A$ of 100 mm, and a curvature radius of a tip $R_A$ of 50 mm. The indenter 3 applied shock to the press-molded product 80 at a loading rate of 4.4 m/s from a position 1 m above the bottom 86 of the press-molded product 80.

Figure 35:
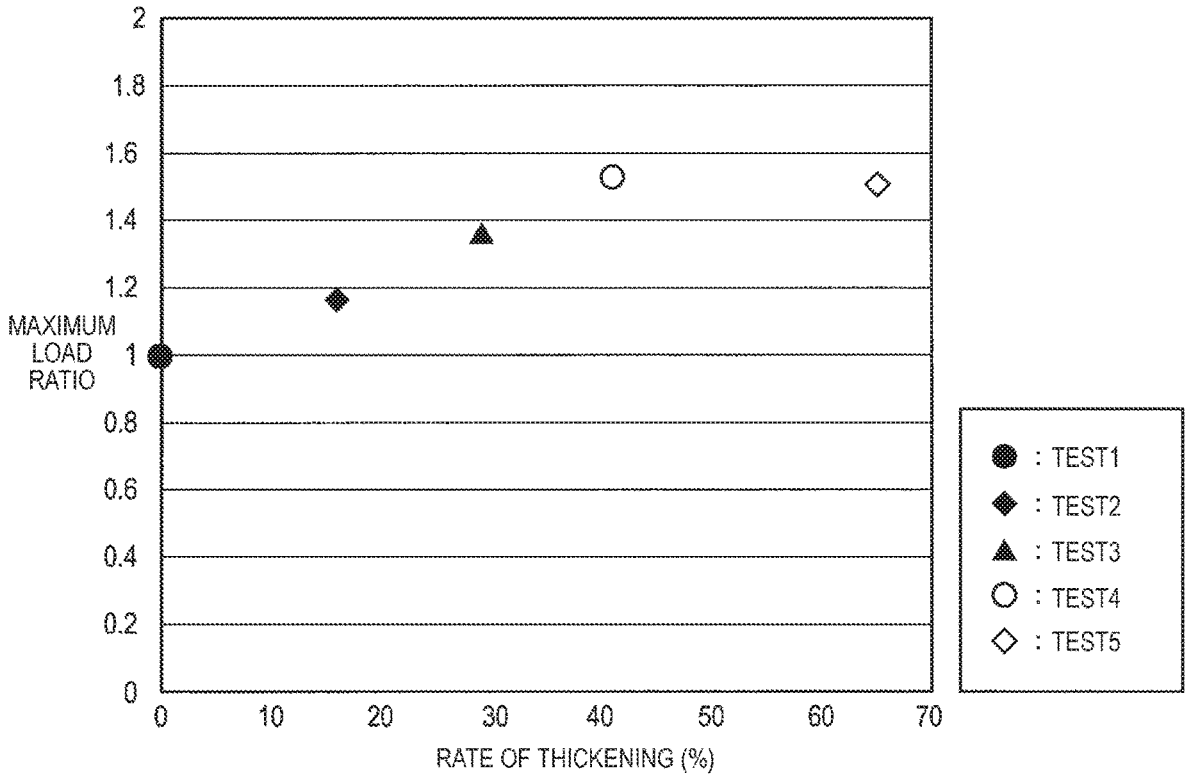
FIG. 35 is a graph showing rates of thickening and maximum load ratios of press-molded products used in Tests 1 to 5.

FIG. 35 shows rates of thickening and maximum load ratios of the press-molded products used in Tests 1 to 5, as results of the three-point bending test. Here, a sheet thickness and a maximum load of a punch-nose of the press-molded product of Test 1 are used as a reference. As shown in FIG. 35, the maximum load ratio becomes larger as the rate of thickening of the punch-nose increases, and the maximum load ratio of the press-molded product of Test 4 is approximately 1.5 times as much. Thus, by increasing the rate of thickening of the punch-nose, initial load can be absorbed effectively, and an improvement in crash safety can be expected in use as a shock absorption member of a car, for example.

Moreover, in addition to having the punch-nose whose sheet thickness is increased from a sheet thickness of the work, the press-molded products of Tests 2 to 5 used in the present example have a work-hardened area in the bottom and the punch-nose, as illustrated in FIGS. 7 and 8, by being molded by the press-working apparatus 700 described above. It is understood that, consequently, the press-molded products of Tests 2 to 5 exhibit high crushing load in the three-point bending test. Note that a press-molded product having a U-shaped portion, which is press-molded by a conventional press-molding apparatus, has a work-hardened area only in a punch-nose, and exhibits a small increase in strength due to work hardening. Therefore, it is presumed that a press-molded product molded by a conventional technique cannot have high shock absorption performance, unlike a press-molded product molded by a technique of the present invention. In addition, as described in the above embodiments and the present example, a press-working method for molding a press-molded product according to the present invention is simple, and makes it possible to easily provide, at low cost, a shock absorption member with high crushing load with respect to three-point bending load.

The preferred embodiment(s) of the present invention has/have been described above with reference to the accompanying drawings, whilst the present invention is not limited to the above examples. A person skilled in the art may find various alterations and modifications within the scope of the appended claims, and it should be understood that they will naturally come under the technical scope of the present invention.

Although a steel sheet is given as an example of a work in the above embodiments, the present invention is not limited to this example. For example, as a work to be subjected to working by a press-working apparatus, a metal sheet of iron, aluminum, titanium, stainless steel, etc., a composite material (metal-resin, different types of metal), and carbon fibers can also be used. Furthermore, the present invention is also applicable to hot stamping of performing press working in state where a work is heated to a predetermined temperature to be softened. In this case, a press-working apparatus and a press-working method of the present invention are applied to and performed in press working after heating of the work. Also in a press-molded product molded by hot stamping, a punch-nose of a U-shaped portion is thickened. In addition, a press-molded product molded by the press-working apparatus can be used for not only cars or car parts, for example, but also various vehicles, general machines, home electrical appliances, shipping, etc.

REFERENCE SIGNS LIST

10, 20, 30, 40 work
12, 22, 32, 42 wall
14, 24, 34, 44 bottom
18, 28, 38, 48 punch-nose
19, 49 end surface
50, 60, 70A, 70B, 70C molded product
100, 200, 300 press-working apparatus
400, 500, 600 press-working apparatus (second press-working apparatus)
120, 220, 420, 520, 620 die
122, 222 fixed die
124, 224, 524 movable die
126, 226, 430 recessed portion
140, 340, 440, 540, 640 punch
142, 344, 442, 542, 642 fixed punch
144 outside movable punch
146 inside movable punch
346, 444, 544, 644 movable punch
360 blank holder

The invention claimed is:

1. A press-working apparatus configured to provide a molded product by performing press working on a work, the molded product including, in a cross-section, a U-shaped portion including a bottom, a wall, and a punch-nose between the bottom and the wall, the press-working apparatus comprising:

a die in which a recessed portion to receive the U-shaped portion is formed;

a first punch that sandwiches a central area of the bottom with a bottom surface of the recessed portion; and a second punch having a punch shoulder with a predetermined radius of curvature that is pushed into the recessed portion later than the first punch, to restrain the wall between the second punch and a side surface of the recessed portion, and sandwich the work with the bottom surface to mold a peripheral area of the bottom and the punch-nose, a least a portion the first punch movably disposed within the second punch, wherein a sandwiching width of the first punch that sandwiches the central area of the bottom and a setback amount of the second punch are set to satisfy below;

ST is equal to or more than SA, where ST is a cross-sectional area of a tapered portion between the central area of the bottom and the wall, which is molded by first press working, in Formula (A) represents, SA is a cross-sectional area of a ridge portion of the molded product in which the punch-nose has the target sheet thickness, which is molded by second press working, in Formula (B) represents, or, ST is equal to SB, where ST is a cross-sectional area of a tapered portion between the central area of the bottom and the wall, which is molded by first press working, in Formula (A) represents, SB is a cross-sectional area of a ridge portion of the molded product in which the punch-nose has the target sheet thickness, which is molded by second press working, in Formula (C) represents, $$S_T=\sqrt{(H_1^2+W_1^2)}\times t \quad (A)$$

$$S_A=\frac{1}{4}\{\pi(R_p+t)^2-\pi R_p^2\} \quad (B)$$

$$S_B=(R_p+t)^2-\frac{1}{4}\pi R_p^2 \quad (C)$$

where H1 is a length of the tapered portion in a push-in direction correspond to the setback amount of the second punch, W1 is a length of the tapered portion in a width direction, Rp is a curvature radius of an inside of the punch-nose, and t is a sheet thickness of the work.

2. The press-working apparatus according to claim 1, wherein the work has a flat plate shape at the time of starting the press working, and the first punch and the second punch push the flat-plate-shaped work into the recessed portion while maintaining a state where the second punch is set back relative to the first punch by first pressing, to mold the wall and the central area of the bottom.

3. The press-working apparatus according to claim 2, wherein the second punch is pushed into the recessed portion by second press working, to sandwich the work with the bottom surface to mold the peripheral area of the bottom and the punch-nose.

4. The press-working apparatus according to claim 1, wherein the molded product is a long member in which the U-shaped portion forms a channel shape.

5. The press-working apparatus according to claim 1, wherein the molded product is an axisymmetric member in which the U-shaped portion forms a cup shape.

6. The press-working apparatus according to claim 1, wherein the punch-nose is molded to have a larger sheet thickness than the wall and the bottom.

7. The press-working apparatus according to claim 1, wherein an outside of the punch-nose is molded to be substantially right-angled.

8. The press-working apparatus according to claim 1, further comprising a third punch that abuts against an end surface of the wall on an opposite side to the punch-nose, and is pressed toward the bottom surface after molding of the punch-nose.

9. A press-working method configured to provide a molded product by performing press working on a work, the molded product including, in a cross-section, a U-shaped portion including a bottom, a wall, and a punch-nose between the bottom and the wall, the press-working method comprising:

a first press-working step of a first punch sandwiching a central area of the bottom with a bottom surface of a recessed portion of a die; and a second press-working step of a second punch having a punch shoulder with a predetermined radius of curvature being pushed into the recessed portion of the die later than the first punch, to restrain the wall between the second punch and a side surface of the recessed portion, and sandwich the work with the bottom surface to mold a peripheral area of the bottom and the punch-nose, a least a portion the first punch movably disposed within the second punch, wherein a sandwiching width of the first punch that sandwiches the central area of the bottom and a setback amount of the second punch from the first punch in a push-in direction are set to satisfy below;

ST is equal to or more than SA, where ST is a cross-sectional area of a tapered portion between the central area of the bottom and the wall, which is molded by first press working, in Formula (D) represents, SA is a cross-sectional area of a ridge portion of the molded product in which the punch-nose has the target sheet thickness, which is molded by second press working, in Formula (E) represents, or, ST is equal to SB, where ST is a cross-sectional area of a tapered portion between the central area of the bottom and the wall, which is molded by first press working, in Formula (D) represents, SB is a cross-sectional area of a ridge portion of the molded product in which the punch-nose has the target sheet thickness, which is molded by second press working, in Formula (F) represents, $$S_T=\sqrt{(H_1^2+W_1^2)}\times t \quad (D)$$

$$S_A=\frac{1}{4}\{\pi(R_p+t)^2-\pi R_p^2\} \quad (E)$$

$$S_B=(R_p+t)^2-\frac{1}{4}\pi R_p^2 \quad (F)$$

where H1 is a length of the tapered portion in a push-in direction correspond to the setback amount of the second punch, W1 is a length of the tapered portion in a width direction, Rp is a curvature radius of an inside of the punch-nose, and t is a sheet thickness of the work.

10. The press-working method according to claim 9, wherein the work has a flat plate shape at the time of starting the press working, and in the first press-working step, the first punch and the second punch push the flat-plate-shaped work into the recessed portion while maintaining a state where the second punch is set back relative to the first punch, to mold the wall and the central area of the bottom.

11. The press-working method according to claim 10, wherein in the second press-working step, the second punch is pushed into the recessed portion, to sandwich the work with the bottom surface to mold the peripheral area of the bottom and the punch-nose.

12. The press-working method according to claim 9, comprising a heating step of heating the work to a predetermined temperature before the first press-working step.

13. The press-working method according to claim 9, further comprising a receiving step of causing the recessed portion formed in the die to receive the U-shaped portion of the molded product before the first press-working step.

14. The press-working method according to claim 9, further comprising an additional molding step of, using the molded product including, in a cross-section, the U-shaped portion including the bottom, the wall, and the punch-nose as a second work, molding a second molded product by pushing in an end surface of the wall of the second work by a fifth punch in a state where the bottom of the second work is sandwiched by a second die and a fourth punch, wherein the additional molding step uses a second press-working apparatus including the second die that has a shape corresponding to a shape of the second molded product, has a recessed portion to accommodate the second work, and supports at least the bottom of the second work, the fourth punch that sandwiches the bottom of the second work with the second die, and the fifth punch that pushes in the end surface of the wall of the second work to mold the second molded product.

15. The press-working method according to claim 14, wherein the recessed portion of the second die of the second press-working apparatus is formed in a manner that a length of the recessed portion in an opposing direction of a wall of the work is greater than a length between opposing outer surfaces of the wall, and in the additional molding step, the wall of the second work is thickened by pushing in the end surface of the wall of the second work by the fifth punch in a state where the bottom of the second work is sandwiched by the second die and the fourth punch.

16. The press-working method according to claim 14, wherein a portion of the second die of the second press-working apparatus that supports the bottom of the second work includes a fixed die that supports a central area and a movable die that supports an end and is movable in an extension direction of the wall, and in the additional molding step, a vertical wall extended portion extended from the wall is formed by moving the movable die by pushing in the end surface of the wall of the second work by the fifth punch in a state where the bottom of the second work is sandwiched by the second die and the fourth punch.

17. The press-working method according to claim 14, wherein in a portion of the second die of the second press-working apparatus that supports the wall of the second work, a step portion recessed in a direction going away from the wall is formed at a position corresponding to the bottom of the second work, and in the additional molding step, a ceiling extended portion extended from the bottom is formed by pushing in the end surface of the wall of the second work by the fifth punch in a state where the bottom of the second work is sandwiched by the second die and the fourth punch.

* * * * *